US008286531B2

(12) United States Patent
Jones et al.

(10) Patent No.: US 8,286,531 B2
(45) Date of Patent: Oct. 16, 2012

(54) AUTOMATIC BALANCING DEVICE

(75) Inventors: David Michael Jones, Gloucestershire (GB); Matthew Damian Harrison, Bristol (GB); Matthew Charles Edward Wilson, Wiltshire (GB)

(73) Assignee: Dyson Technology Limited, Malmesbury (GB)

( * ) Notice: Subject to any disclaimer, the term of this patent is extended or adjusted under 35 U.S.C. 154(b) by 1188 days.

(21) Appl. No.: 11/666,889

(22) PCT Filed: Nov. 7, 2005

(86) PCT No.: PCT/GB2005/004301

§ 371 (c)(1),
(2), (4) Date: Aug. 20, 2007

(87) PCT Pub. No.: WO2006/054046

PCT Pub. Date: May 26, 2006

(65) Prior Publication Data

US 2008/0034917 A1 Feb. 14, 2008

(30) Foreign Application Priority Data

Nov. 17, 2004 (GB) ..... 0425313.4

(51) Int. Cl.
*F16F 15/32* (2006.01)
*D06F 37/22* (2006.01)

(52) U.S. Cl. ..... 74/572.4; 68/23.2; 210/144

(58) Field of Classification Search ..... 74/572.4, 74/570.2, 571.1, 573.1; 68/23.2, 24, 139; 210/144, 363

See application file for complete search history.

(56) References Cited

U.S. PATENT DOCUMENTS

| | | | | |
|---|---|---|---|---|
| 2,984,094 | A * | 5/1961 | Belaieff | 68/23.2 |
| 3,178,916 | A * | 4/1965 | Belaieff et al. | 68/23.2 |
| 3,356,222 | A * | 12/1967 | Belaieff | 210/363 |
| 5,460,017 | A * | 10/1995 | Taylor | 68/23.2 |
| 5,806,349 | A | 9/1998 | Kim et al. | |
| 5,813,253 | A | 9/1998 | Uhlin | |
| 6,327,732 | B1 | 12/2001 | Braunschweig et al. | |
| 2005/0144736 | A1 | 7/2005 | Jones | |

FOREIGN PATENT DOCUMENTS

| | | |
|---|---|---|
| CH | 345322 | 3/1960 |
| DE | 197 05 604 A1 | 3/1998 |
| GB | 1035033 | 7/1966 |
| GB | 1092188 | 11/1967 |
| GB | 2029864 | 3/1980 |
| GB | 2104553 | 3/1983 |
| GB | 2 388 849 A | 11/2003 |

* cited by examiner

*Primary Examiner* — James Pilkington
*Assistant Examiner* — Thomas Diaz
(74) *Attorney, Agent, or Firm* — Morrison & Foerster LLP

(57) ABSTRACT

An automatic balancing device for counterbalancing an out-of-balance mass includes a plurality of counterbalancing masses, each of which is movable in a circular path about the axis so as to generate a balancing force. The balancing forces combine to produce a resultant balancing force which varies between minimum and maximum values. At a first speed of rotation of the body about the axis, the movement of at least one of the counterbalancing masses is restrained so that a substantially constant, non-zero resultant balancing force is produced, the resultant balancing force being freely movable about the axis. At a second speed of rotation of the body about the axis, the counterbalancing masses are free to adopt a position in which the out-of-balance mass is counterbalanced. The device allows at least partial counterbalancing of the out-of-balance mass at speeds below the critical speed of the system in which it is used.

21 Claims, 15 Drawing Sheets

AUTOMATIC BALANCING DEVICE

REFERENCE TO RELATED APPLICATIONS

This application is a national stage application under 35 USC 371 of International Application No. PCT/GB2005/004301, filed Nov. 7, 2005, which claims the priority of United Kingdom Application No. 0425313.4, filed Nov. 17, 2004, the contents of both of which prior applications are incorporated herein by reference.

FIELD OF THE INVENTION

The invention relates to an automatic balancing device for counterbalancing an out-of-balance mass present in a body which is rotatable about an axis. Particularly, but not exclusively, the invention relates to an automatic balancing device which is suitable for use in a washing machine for counterbalancing out-of-balance masses in washing machines during washing and spinning cycles.

BACKGROUND OF THE INVENTION

Automatic balancing devices for counterbalancing out-of-balance masses in rotating bodies are known. Many work on the well-known principle that, at speeds above the critical speed of the system in which the body is rotating, freely-rotatable counterbalancing masses will automatically take up positions in which the out-of-balance mass is counterbalanced. It has also been recognised that, if these counterbalancing masses are left unconstrained at speeds below the critical speed, they exacerbate the excursion of the rotating body which is highly undesirable. In order to remove this problem, devices have been proposed in which, at speeds below critical, the counterbalancing masses are locked in a balanced position about the axis so that, instead of having a detrimental effect on the system, they have no effect at all. Examples of such systems are shown in U.S. Pat. No. 5,813,253 and GB 1,092,188.

GB 2,388,849 discloses an improved automatic balancing system suitable for use in a washing machine in which constraining means are permanently provided on the two counterbalancing masses so as to limit the separation of the masses at speeds both above and below critical. A certain amount of counterbalancing at below critical speeds can be achieved with this system. This system has merit but suffers from the disadvantage that the amount of counterbalancing achievable below the critical speed varies with time and so the point at which the speed of rotation is increased to and through the critical speed needs to be carefully controlled in order to achieve the best results. The fact that the same constraints are applied to the counterbalancing masses at speeds both above and below critical can also inhibit the effect of the masses in some cases.

SUMMARY OF THE INVENTION

An object of the invention is to provide an automatic balancing system in which the counterbalancing masses are able to provide at least partial counterbalancing at sub-critical speeds but are also free to provide a full counterbalancing effect at speeds above the critical speed. It is a further object of the invention to provide an automatic balancing system by means of which the maximum excursion of the rotating body is minimised reliably and simply.

The invention provides an automatic balancing device for counterbalancing an out-of-balance mass present in a body which is rotatable about an axis of a dynamic system having a critical speed, the automatic balancing device comprising a plurality of counterbalancing masses, each of which is movable in a circular path about the axis so as to generate a balancing force, the balancing forces combining, in use, to produce a resultant balancing force which is variable between a minimum value and a maximum value, characterised in that the automatic balancing device is configured so that, at a first speed of rotation of the body which is below the critical speed, the movement of at least one of the counterbalancing masses is restrained so that a substantially constant, non-zero resultant balancing force is produced, the said resultant balancing force being freely movable about the axis, and, at a second speed of rotation of the body which is above the critical speed, the counterbalancing masses are free to adopt a position in which the out-of-balance mass is counterbalanced.

The production of a non-zero resultant balancing force, as a result of the restraint of at least one of the counterbalancing masses, allows an out-of-balance mass in the body to be partially counterbalanced at below-critical speeds. Ensuring that the resultant balancing force is substantially constant eliminates or reduces the amount of variation in the counterbalancing capability over time. This means that, when the speed of rotation of the body needs to be increased to and through the critical speed, there is no need to exercise the level of control which would otherwise need to be exercised in order to keep the maximum excursion to a minimum. The benefits of keeping the maximum excursion to a minimum are well understood.

Preferably, the second speed of rotation is any speed above a predetermined speed which is above the critical speed of the said system. This reduces the potential for unwanted oscillations which may occur if the counterbalancing masses are free to move at all speeds above the critical speed.

It is preferred that the minimum value of the resultant balancing force is zero to allow complete balancing to take place when there is no out-of-balance mass in the body.

It is preferred that, at the first speed of rotation, the resultant balancing force is less than half, more preferably between 5% and 35%, and still more preferably between 15% and 20% of the maximum value of the resultant. It has been found that these values reliably provide an adequate amount of counterbalancing for a range of out-of-balance values in the practical application of a washing machine.

Preferably, the automatic balancing device further comprises restraining means, the restraining means being operative at the first speed of rotation and inoperative at the second speed of rotation. Such an arrangement allows different modes of operation to be used for below-critical and above-critical speeds, thus ensuring that the benefits of each mode of operation can be enjoyed without compromising the operation of the device in either mode.

In a preferred embodiment, two counterbalancing masses are pivotably mounted about the axis. When the restraining means are operative, the angle between the balancing forces generated by the counterbalancing masses is between 140° and 175°, preferably between 155° and 165°. Again, it has been found that these values provide an adequate amount of counterbalancing for a range of out-of-balance values in a practical application, particularly in the context of a washing machine.

In an alternative embodiment, at least three counterbalancing masses are provided and, when the restraining means are operative, all but one of the counterbalancing masses are prevented from moving with respect to one another so that no resultant balancing force is produced, the remaining counterbalancing mass being freely pivotable about the axis. This arrangement has the advantage of being relatively simple to construct.

In a further alternative embodiment, which is primarily suitable for use with a vertical axis arrangement, the counterbalancing masses are supported on a support surface having a central portion, an annular race arranged axially outwardly of the central portion, and an upwardly inclined portion extending between the central portion and the annular race, the restraining means comprising a cylindrical lip arranged between the central portion and the upwardly inclined portion. The counterbalancing masses are formed as spherical balls which are dimensioned so as to form a continuous circle immediately inwardly of the cylindrical lip and at least one of the spherical balls has a reduced mass in comparison to the mass of the remaining balls. Preferably, the number of balls is at least two and is not a factor of the total number of balls. This type of arrangement has the advantage that, apart from the balls, no moving parts are required and that, when the balls are arranged inside the lip, the presence of the reduced-mass balls will ensure that a fixed resultant balancing force is produced.

The invention also provides a mechanism for counterbalancing an out-of-balance mass present in a body which is rotatable about an axis, comprising a first automatic balancing device as previously described and a second automatic balancing device as previously described, the first and second automatic balancing devices being arranged coaxially but spaced apart from one another along the said axis.

The invention further provides a method of counterbalancing an out-of-balance mass present in a body which is rotatable about an axis, the body being provided with a balancing device having a plurality of counterbalancing masses, each of which is moveable in a circular path about the axis, the method comprising the steps of:

(a) rotating the body at a speed which is below the critical speed of the system of which the body forms a part so that each counterbalancing mass generates a balancing force;

(b) restraining the movement of at least some of the counterbalancing masses in such a manner that a substantially constant, non-zero resultant balancing force is produced, the said resultant balancing force being freely moveable about the axis;

(c) increasing the speed of rotation of the body to a speed above the critical speed of the system of which the body forms a part; and (d) removing the restraint from the counterbalancing masses.

The benefits of the method according to the invention are similar to those of the apparatus according to the invention.

Preferably, the step of restraining the movement of at least some of the counterbalancing masses includes connecting all of the counterbalancing masses to one another to prevent relative movement therebetween whilst still allowing rotation of the connected counterbalancing masses about the axis. More preferably, the resultant balancing force produced thereby is between 5% and 35%, advantageously between 15% and 20% of the maximum possible resultant balancing force. As before, these values provide an adequate amount of counterbalancing for a range of out-of-balance values.

Further advantageous and preferred features are set out in the preferred embodiments disclosed herein.

BRIEF DESCRIPTION OF THE DRAWINGS

Embodiments of the invention will now be described with reference to the accompanying drawings in which.

DETAILED DESCRIPTION OF THE INVENTION

Figure 1:
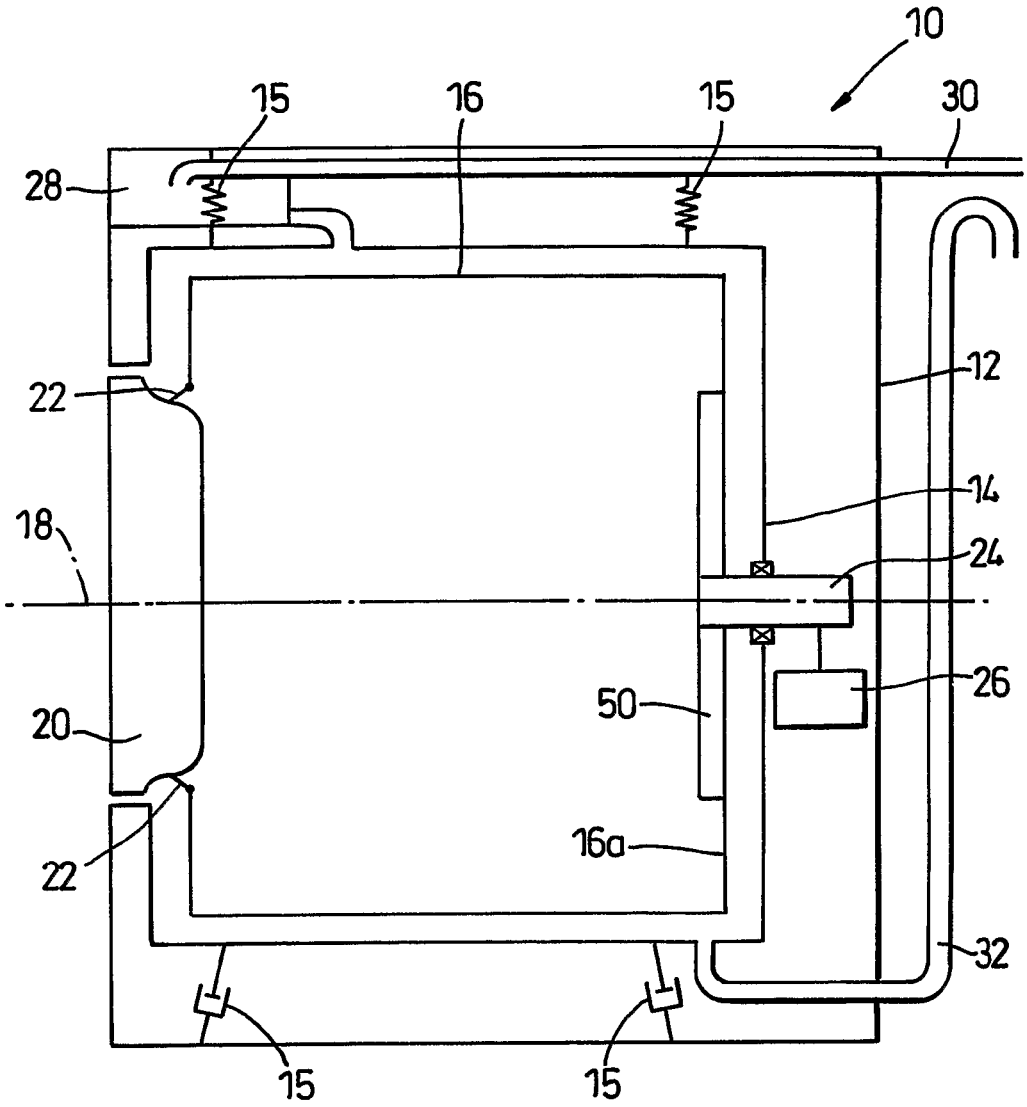
FIG. 1 is a schematic sectional side view of a washing machine incorporating an automatic balancing device according to a first embodiment of the invention.

FIG. 1 illustrates a typical environment in which an automatic balancing device is useful and desirable. FIG. 1 shows a washing machine 10 having an outer casing 12 and a tub 14 mounted inside the outer casing 12 by way of a system of springs and dampers 15. A perforated drum 16 is mounted inside the tub 14 so as to be rotatable about an axis 18. In this embodiment, the axis 18 extends horizontally although this is not essential and the axis 18 could be inclined to the horizontal. Indeed, the entire arrangement could be rotated through 90° so that the axis is arranged vertically or substantially vertically. A hinged door 20 is located in the front face of the outer casing 12 in such a manner that, when the door 20 is in a closed position (as illustrated), the tub 14 is sealed in a watertight manner. The door 20 is openable to allow articles of laundry to be placed inside the drum 16 prior to the commencement of a washing cycle to be carried out by the washing machine 10. Flexible seals 22 are also provided between the drum 16 and the door 20 so that moderate movements of the drum 16 with respect to the outer casing 12 can be tolerated.

The drum 16 is mounted in a rotatable manner by way of a shaft 24 which is supported on the tub 14 and driven by a motor 26. The shaft 24 passes through the tub 14 and into the interior thereof so as to support the drum 16. The drum 16 is fixedly connected to the shaft 24 so as to rotate therewith about the axis 18. It will be understood that the shaft 24 passes through the wall of the tub 14 in such a manner as to cause no rotation of the tub 14. Such mounting arrangements are well known in the art. The washing machine 10 also includes a soap tray 28 for the introduction of detergent, one or more water inlet pipes 30 leading to the tub 14 via the soap tray 28, and a water drain 32 communicating with the lower portion of the tub 14.

All of the features thus far described in relation to the washing machine 10 are known per se and do not form essential parts of the present invention. Common variants of any or all of these features may therefore be included in a washing machine capable of incorporating or utilising an automatic balancing device according to the invention if desired.

Figure 2:
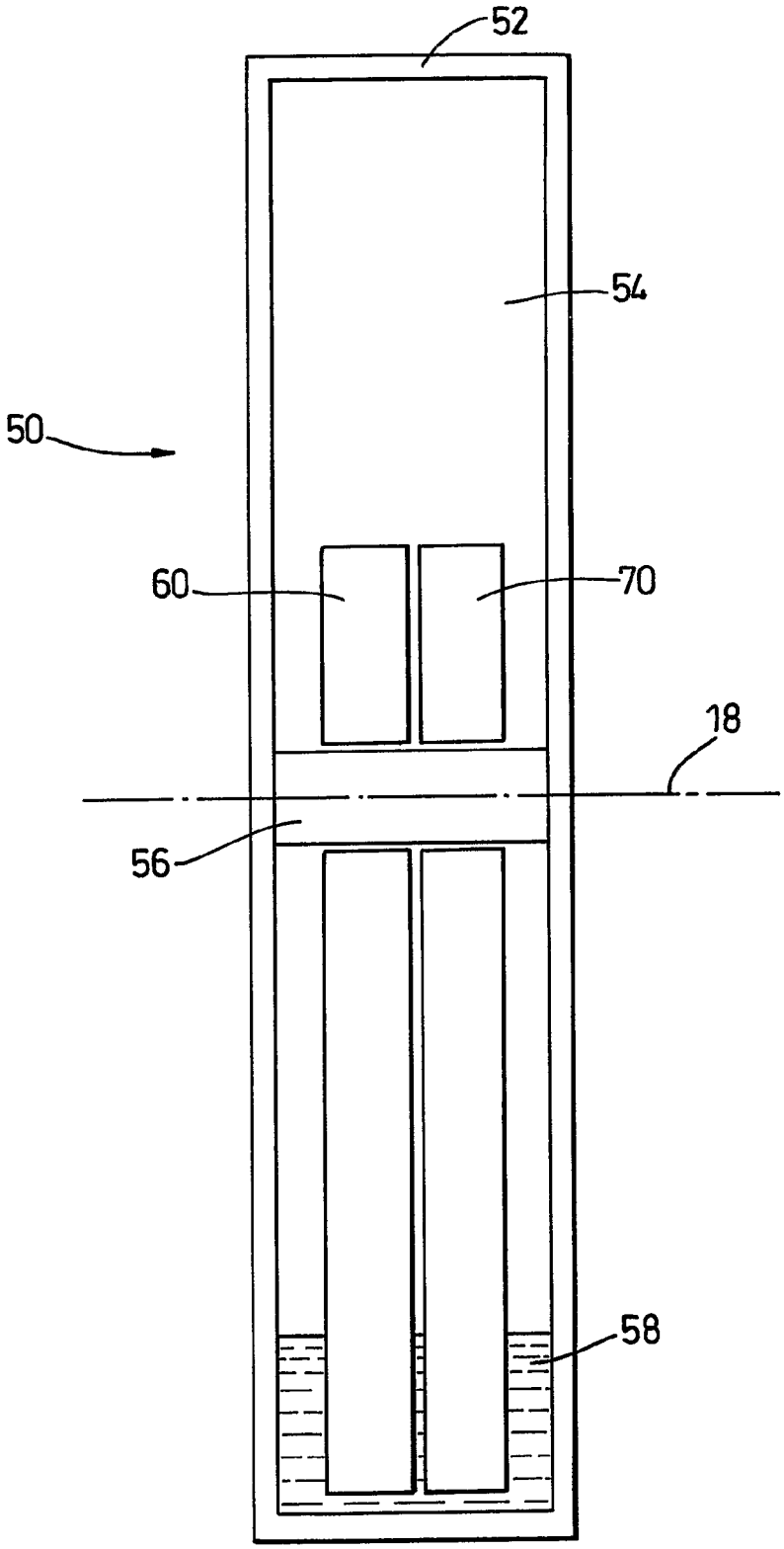
FIG. 2 is a schematic side sectional view, on an enlarged scale, through the automatic balancing device forming part of the washing machine of FIG. 1.

The washing machine 10 shown in FIG. 1 incorporates an automatic balancing device 50 according to the invention. The automatic balancing device 50 is located on the rear wall 16*a* of the drum 16, remote from the door 20, and is arranged to rotate with the drum 16. The automatic balancing device 50 is shown more clearly in FIG. 2. It consists of a wall 52 which delimits a cylindrical chamber 54. Part of the wall 52 can be formed by the rear wall 16*a* of the drum 16. An axle 56 extends across the chamber 54, the axle 56 lying coincident with the axis 18 about which the drum 16 rotates. Supported on the axle 56 are two counterbalancing masses 60, 70. The counterbalancing masses 60, 70 are axially spaced along the axle 56 and are mounted thereon by way of bearings (not shown) so as to be freely rotatable about the axis 18 and within the chamber 54.

A viscous fluid 58 (eg. oil) is provided in the chamber 54. The amount of oil 58 is selected to ensure that, when the wall 52 of the chamber 54 is rotated with the drum 16, there is sufficient viscous coupling provided between the wall 52 and the counterbalancing masses 60, 70 to cause the counterbalancing masses 60, 70 to rotate about the axle 56. This technique is well known.

Figure 3:
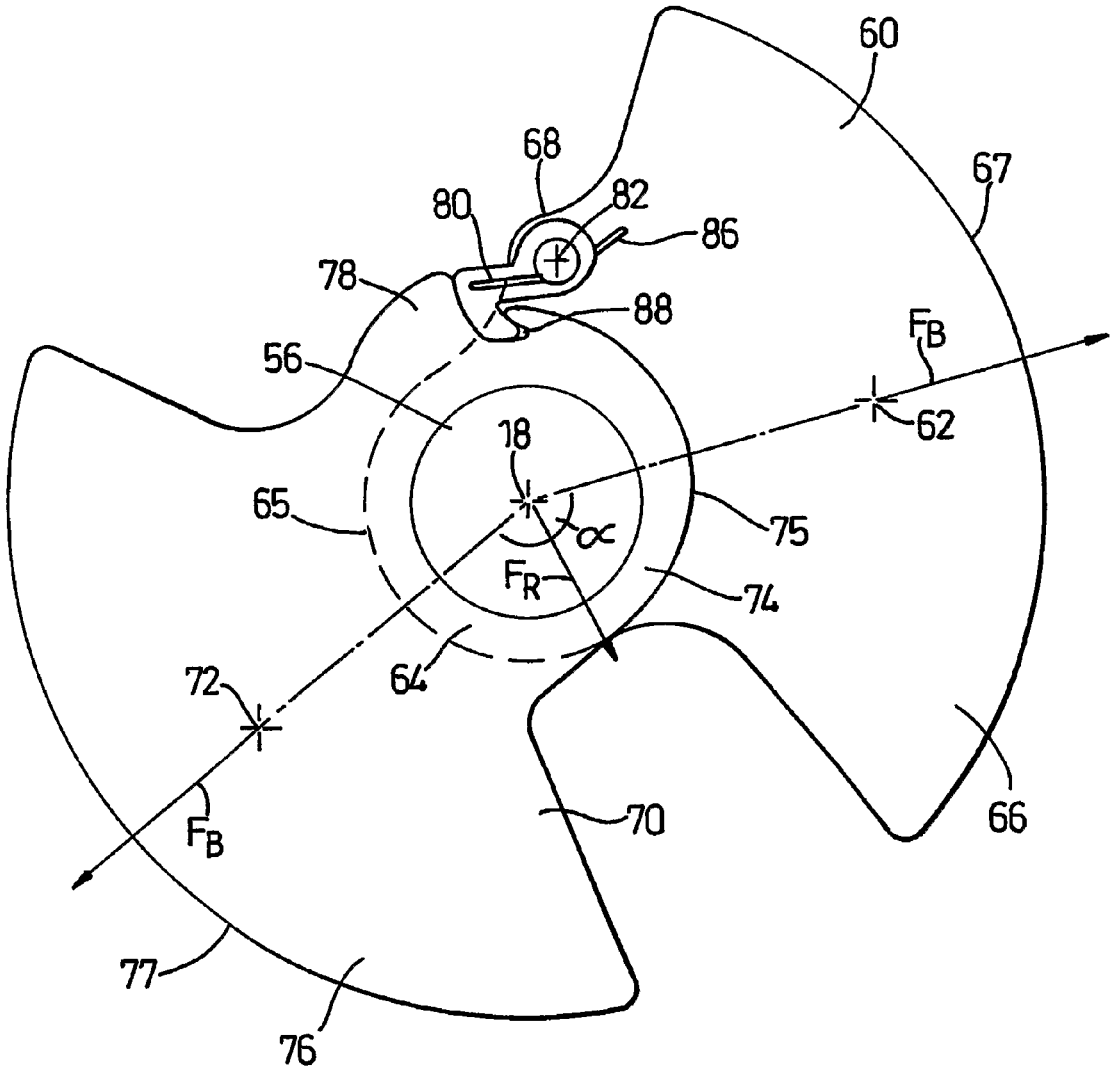
FIG. 3 is a front view of the essential parts of the automatic balancing device of FIG. 2 showing the counterbalancing masses latched together.

The counterbalancing masses 60, 70 are shown in front view in FIG. 3. Both counterbalancing masses 60, 70 are generally the same shape, although this is not essential. Each counterbalancing mass 60, 70 is shaped so that its centre of mass 62, 72 is spaced away from the axis 18. It will be understood that, as the counterbalancing masses 60, 70 rotate about the axis 18, a balancing force $F_B$ passing through the respective centre of mass 62, 72 will be generated. Each counterbalancing mass 60, 70 has a relatively small inner portion 64, 74 through which the axle 56 passes and which has a radially outer edge 65, 75 which lies relatively close to the axle 56. Each counterbalancing mass 60, 70 also has a relatively large outer portion 66, 76 having a radially outer edge 67, 77 which lies close to the wall 52 of the chamber 54. Each counterbalancing mass 60, 70 also has an enlarged portion 68, 78 on one side of the inner portion 64, 74 for reasons which will be explained below.

Figure 4:
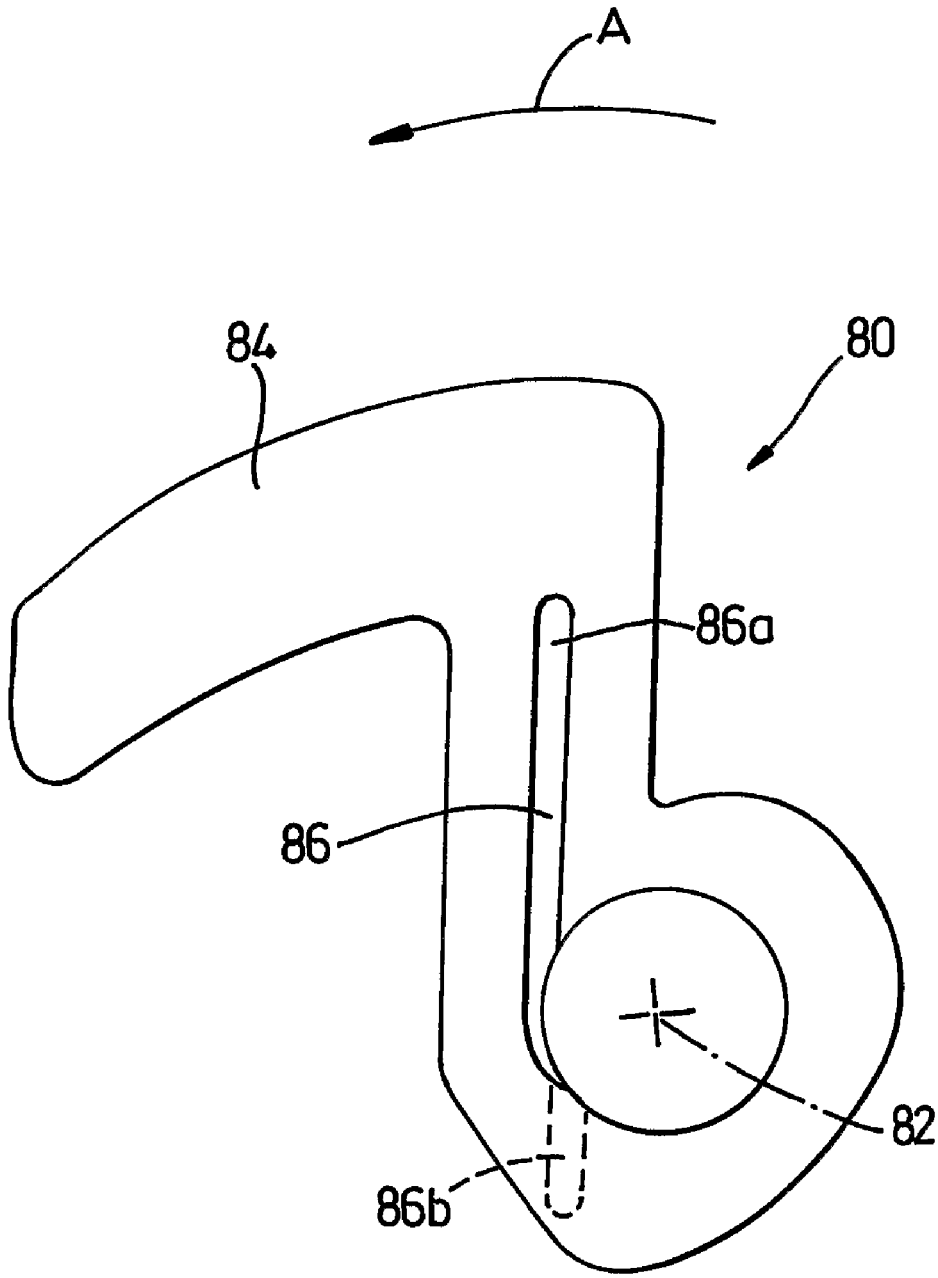
FIG. 4 is a front view of a latch forming part of the automatic balancing device of FIG. 2, the latch being shown on a greatly enlarged scale.

Shown in FIGS. 3 and 4 are the means by which the counterbalancing masses 60, 70 are restrained at speeds below the critical speed of the system in which they are used, ie. the tub 14 as it is mounted in the washing machine 10. The restraining means comprise a moveable latch 80 which is mounted on one of the counterbalancing masses 60. The latch 80 is positioned on the enlarged portion 68 of the counterbalancing mass 60 and on the side face thereof adjacent the other counterbalancing mass 70 so that the latch 80 lies in the same plane as the other counterbalancing mass 70. The latch 80 is rotatably mounted about an axis 82 and has a head portion 84 which is urged in an anticlockwise direction, as indicated by arrow A in FIG. 4, by a torsion spring 86. One end 86*a* of the spring 86 is seated in a recess in the latch and the other end 86*b* is seated in the side face of the counterbalancing mass 60. The other counterbalancing mass 70 includes a recess 88 which is formed in the inner portion 74 adjacent the enlarged portion 78. The recess 88 is shaped so as to receive the head portion 84 of the latch 80. The enlarged portion 78 extends radially outwardly beyond the radially outer edge 75 of the inner portion 74 for reasons which will be explained below.

The shape and mass of the latch 80 and the characteristics of the spring 86 are selected so that, at a predetermined speed of rotation of the counterbalancing masses 60, 70, the head portion 84 of the latch 80 will move radially outwards against the bias of the spring 86 about the axis 82. The predetermined speed of rotation at which this will happen is selected to be above the critical speed of the system.

The operation of the automatic balancing device 50 will now be described in the context of a washing machine. When the drum 16 of the washing machine 10 is rotating at speeds below the critical speed of the system, so in normal washing or rinsing mode, the wall 52 of the chamber 54 will rotate at relatively slow speeds about the axis 18. If the counterbalancing masses 60, 70 are not already latched together, the counterbalancing masses 60, 70 will oscillate gently with respect to one another until the head portion 84 of the latch 80 becomes aligned with the recess 88. The head portion 84 will then drop into the recess 88 under the influence of the spring 86. The counterbalancing masses 60, 70 then become latched together so that they cannot move with respect to one another although the latched masses 60, 70 can still rotate together about the axis 18.

When the counterbalancing masses 60, 70 are latched together, as shown in FIG. 3, their respective centres of mass 62, 72 are held at a fixed distance from one another so that the balancing forces $F_B$ generated by the rotation of the counterbalancing masses 60, 70 about the axis 18 act in directions which are at a fixed angle $\alpha$ to one another. In this embodiment, the angle $\alpha$ is substantially 160° but this angle can be varied between as little as 140° and as much as 175°. What is important is that the balancing forces $F_B$ generated by the rotation of the counterbalancing masses 60, 70 combine to produce a resultant balancing force $F_R$ which is non-zero in magnitude. The resultant balancing force $F_R$ has a constant magnitude which is smaller than the magnitude of either of the balancing forces $F_B$. However, although the counterbalancing masses 60, 70 are latched together, they are still able to rotate about the axis 18. Hence the resultant balancing force $F_R$ is also able to rotate about the axis 18.

The resultant balancing force $F_R$ has been found to be effective in partially counterbalancing the out-of-balance mass present in the drum 16 at speeds below the critical speed of the washing machine system. Whilst full counterbalancing is not possible in many cases, primarily because the out-of-balance mass is too great to be counterbalanced by the comparatively small resultant balancing force $F_R$, it is still possible to achieve partial counterbalancing which reduces the maximum excursion of the tub 14 as the speed of rotation of the drum 16 increases. Indeed, as the speed of rotation of the drum 14 approaches the critical speed, the effect of the resultant balancing force $F_R$ increases and so the benefit to be had also increases.

The benefit of this partial counterbalancing is that, if the maximum excursion of the tub 14 is kept to a minimum, the space provided between the tub 14 and the casing 12 (in which the excursion of the tub 14 is accommodated) can be reduced. This means that, for a given size of casing, a larger tub 14 and drum 16 can be provided. This results in higher peripheral speeds being achievable during spinning cycles and washing machines being able to handle larger out-of-balance loads.

When the counterbalancing masses 60, 70 are latched together as shown in FIG. 3, the rotational speed of the drum 16 can be increased through the critical speed of the system. The maximum excursion of the tub 14 is kept to a minimum by retaining the counterbalancing masses 60, 70 in the latched configuration. When the drum 16 has accelerated through the critical speed to an above-critical speed, the counterbalancing masses 60, 70 must be released so that full counterbalancing of the out-of-balance mass in the drum 16 can be achieved. As has been explained above, the shape and mass of the latch 80, and the characteristics of the spring 86, have been chosen so that, at a speed above the critical speed of the system, the head portion 84 will move radially outwardly against the bias of the spring 86 under centrifugal forces. The head portion 84 thus becomes disengaged from the recess 88 and the counterbalancing masses 60, 70 are thus free to rotate with respect to one another.

Figure 5:
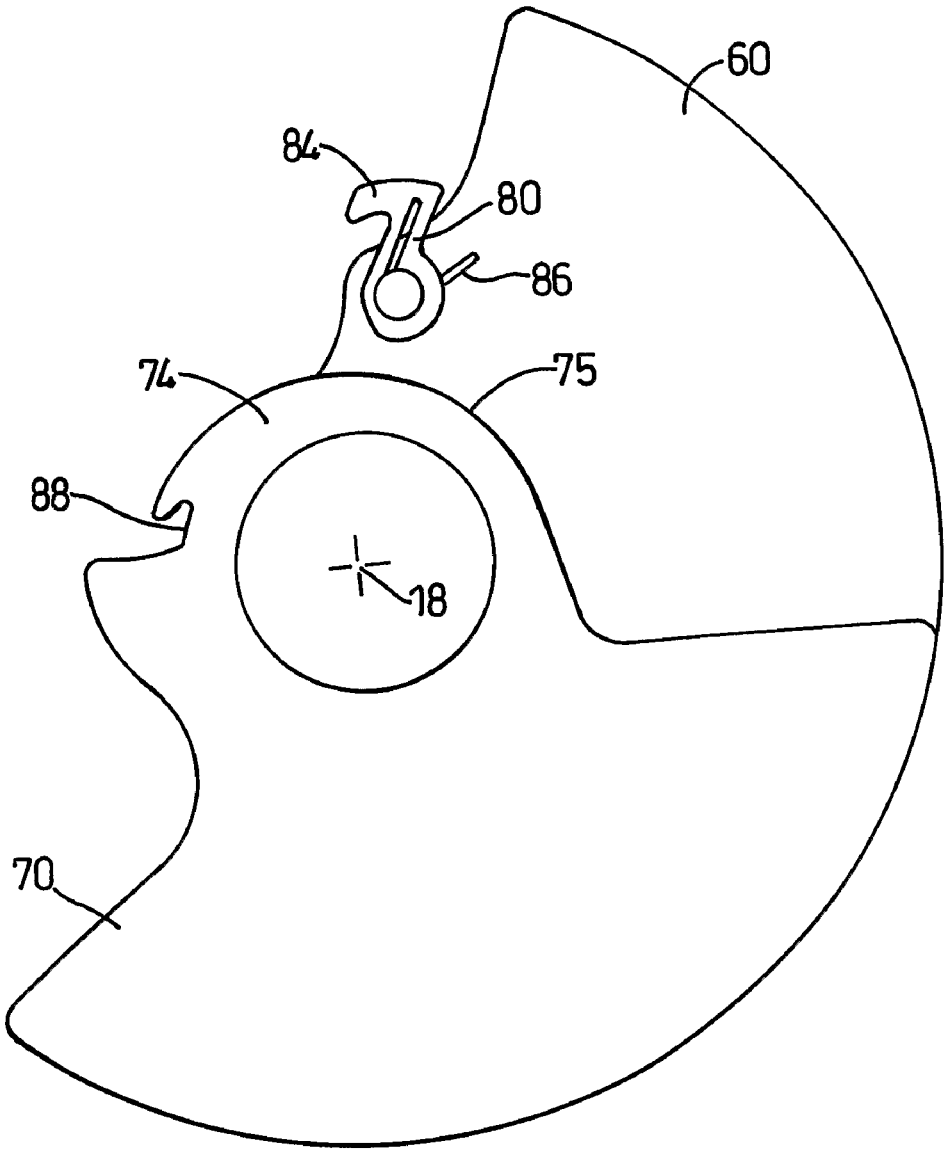
FIG. 5 is a front view similar to FIG. 3 showing the counterbalancing masses unlatched and in an intermediate position.

In the configuration shown in FIG. 5, the head portion 84 of the latch 80 is completely disengaged from the recess 88. The counterbalancing masses 60, 70 are free to take up positions in which the out-of-balance mass in the drum 16 is completely counterbalanced, in the same way as has been achieved in many prior art devices. The position of the enlarged portion 68 of the counterbalancing mass 60 (on which the latch 80 is mounted) is such that the inner portion 74 of the counterbalancing mass 70 does not come into contact with any part of the latch 80. However, the shape of the remainder of the counterbalancing mass 70 does provide limits to the relative movement between the counterbalancing masses 60, 70 and the extremes of movement are shown in FIGS. 6 and 7.

Figure 6:
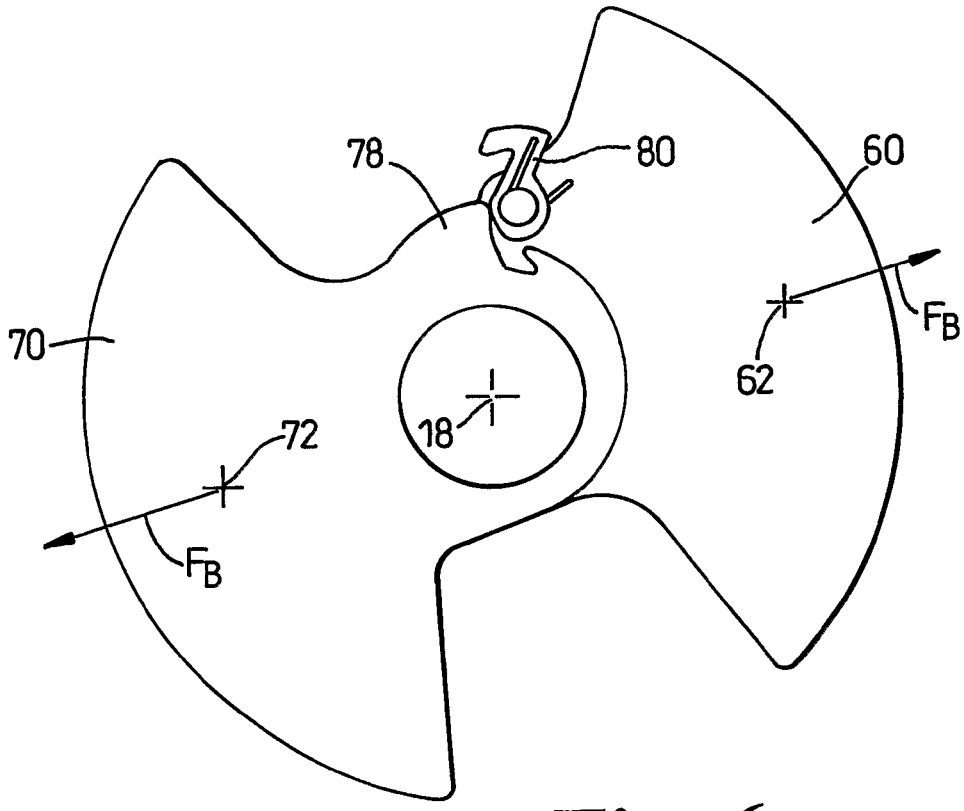
FIG. 6 is a front view similar to FIG. 3 showing, on a reduced scale, the counterbalancing masses unlatched and in a position in which the resultant balancing force is at a minimum value.

In FIG. 6, the counterbalancing masses 60, 70 are positioned diametrically opposite one another. The balancing forces $F_B$ act in opposite directions so that no resultant balancing force is produced. The minimum resultant balancing force is therefore zero in this embodiment. In this position, the latch 80 abuts against the enlarged portion 78 of the counterbalancing mass 70. In FIG. 7, the latch 80 abuts against the edge of the outer portion 76 and the counterbalancing masses 60, 70 lie substantially side by side. The balancing forces $F_B$ generated by the rotation of the counterbalancing masses 60, 70 are substantially aligned and thus the resultant balancing force is at its maximum possible value of $2\times F_B$.

At these extremes of rotational movement, the resultant balancing force $F_R$ is at its minimum and maximum respectively. The concept behind the invention resides in that, at sub-critical speeds, the counterbalancing masses 60, 70 are held fixed with respect to one another so that the resultant balancing force $F_R$ is not zero (as has been the case with all the known prior art) but is not allowed to vary substantially in magnitude. The resultant balancing force $F_R$ is allowed to rotate about the axis 18 so that partial counterbalancing of the out-of-balance mass present in the drum 16 can be achieved. Ideally, the resultant balancing force $F_R$ is held at a fixed value which is between the minimum value achievable by the freely-rotatable counterbalancing masses 60, 70 (as shown in FIG. 6) and the maximum achievable value (as shown in FIG. 7). Ideally, the resultant balancing force $F_R$ is held at between 5% and 35% of the maximum achievable value and tests have shown that holding the resultant balancing force $F_R$ at between 15% and 20% is particularly advantageous in the context of a washing machine. In the embodiment shown in detail in FIGS. 2 to 7, the angle $\alpha$ can be selected according to the application in which the device 50 is to be used. It is believed that the angle $\alpha$ should be selected so that the magnitude of the resultant balancing force $F_R$ should be approximately one third of the largest expected out-of-balance mass present in the rotating body. Angles of between 140° and 175° are expected to give good results in most applications. In the application of a washing machine, angles of between 155° and 165° appear to be favourable and 160° has been found to be particularly effective.

Figure 7:
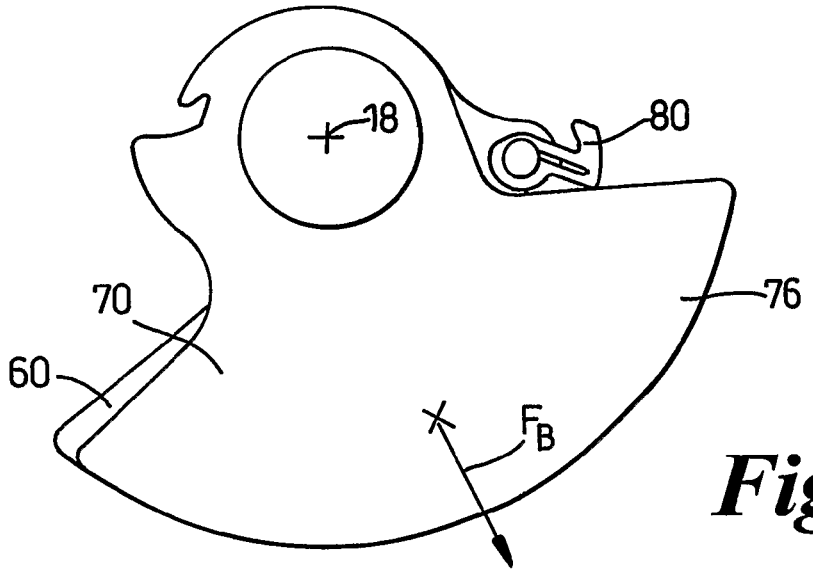
FIG. 7 is a front view similar to FIG. 3 showing, on a similarly reduced scale, the counterbalancing masses unlatched and in a position in which the resultant balancing force is at a maximum value.

Whilst the drum 16 is rotating at speeds above the critical speed (ie. during the spinning cycles), the latch 80 remains in the position shown in FIGS. 5 to 7. Counterbalancing of the out-of-balance mass in the drum 16 is achieved as normal. When the rotational speed of the drum 16 drops below the predetermined speed at which the latch 80 disengages from the recess 88, the head portion 84 moves inwardly under the action of the spring 86 until it touches the radially outer edge 75 of the inner portion 74 of the counterbalancing mass 70. If the counterbalancing masses 60, 70 are rotating with respect to one another, the head portion 84 will slide over the radially outer edge 75 of the inner portion 74 of the counterbalancing mass 70 until the head portion 84 becomes aligned with the recess 88. The head portion 84 then drops into the recess 88 whereupon the counterbalancing masses 60, 70 become relatched in the position shown in FIG. 3. The counterbalancing masses 60, 70 will then remain latched together in this position until the rotational speed of the drum 16 exceeds the speed at which the latch 80 has been designed to become released from the recess 88. However, it is not important that the counterbalancing masses 60, 70 are latched together during the washing and rinsing cycles: it is only essential that the counterbalancing masses 60, 70 are latched together as the speed of rotation of the drum 16 increases towards the critical speed of the system so that the maximum excursion is minimized as the drum 16 accelerates through the critical speed.

A second embodiment of the invention is shown in FIGS. 8 to 10*b*. In this second embodiment, the automatic balancing device 150 again comprises a wall 152 which defines a cylindrical chamber 154. A viscous fluid (not shown) is provided in the chamber 154 to provide viscous coupling between the wall 152 and the counterbalancing masses 160, 170, 190. These counterbalancing masses 160, 170 are again supported next to one another on an axle 156 so as to be freely rotatable about the axis 118, which is again concentric with the drum of the washing machine in which the device 150 is used.

Figure 8:
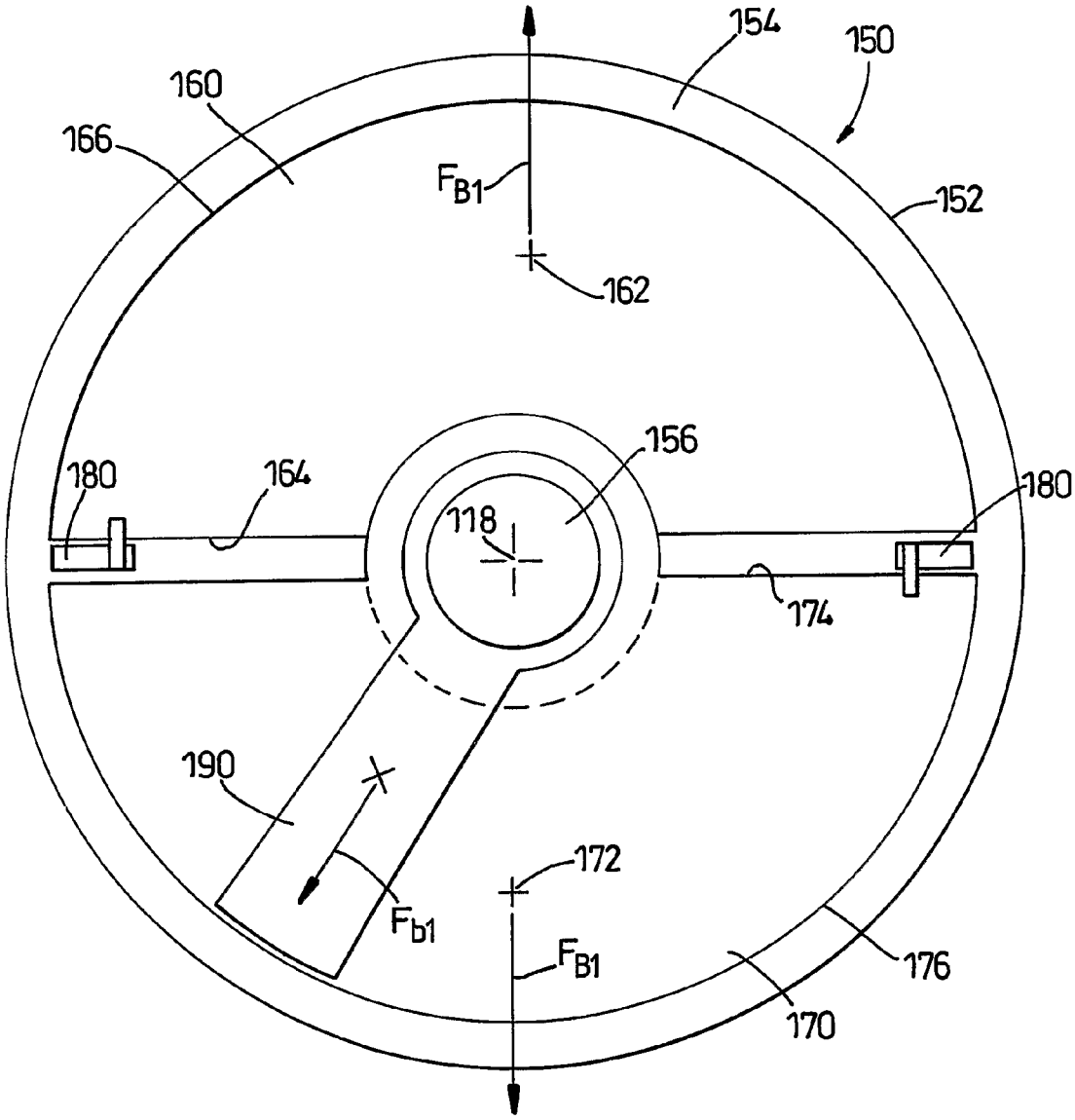
FIG. 8 is a front view of an automatic balancing device according to a second embodiment of the invention showing two counterbalancing masses held in a restrained position.

The counterbalancing masses 160, 170 are generally semicircular in front view, as can be seen from FIG. 8. Their centres of mass 162, 172 are located at a distance from the axis 118 as before. As each counterbalancing mass 160, 170 rotates about the axis 118, a balancing force $F_{B1}$ is generated, the balancing force $F_{B1}$ acting in a direction which passes through the respective centre of mass 162, 172.

A third counterbalancing mass 190 is also provided in the chamber 154. This third counterbalancing mass 190 is also freely rotatably mounted about the axle 156. The third counterbalancing mass 190 is smaller and less massive than the counterbalancing masses 160, 170, but it also generates a balancing force $F_{b1}$ as it rotates about the axis 118. A maximum resultant balancing force will be produced when the balancing forces $F_{B1}$, $F_{b1}$ generated by each counterbalancing mass 160, 170 190 are aligned. The counterbalancing masses 160, 170, 190 are also able to adopt positions relative to one another such that there is no resultant balancing force.

When all three counterbalancing masses 160, 170, 190 are unrestrained and the device 150 is rotating at speeds above the critical speed of the system, they will assume positions about the axis 118 which will counterbalance any out-of-balance mass present in the drum of the washing machine, in a known manner.

Figure 9A:
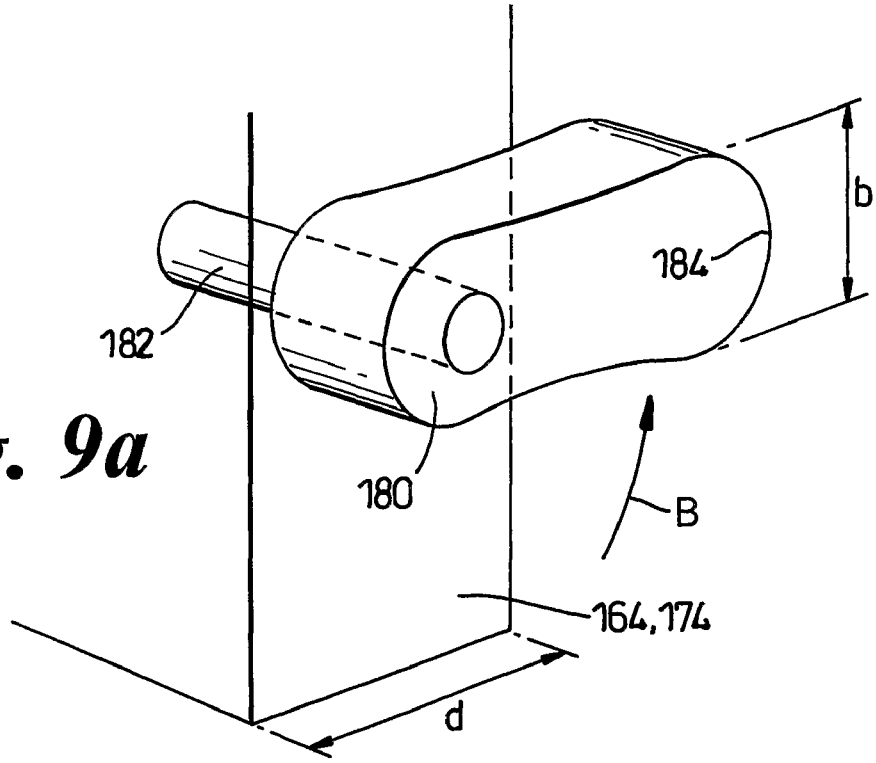
FIGS. 9*a* and 9*b* are three-quarter views of a catch forming part of the device of FIG. 8, the catch being shown in the restraining and unrestraining positions respectively and on an enlarged scale.
Figure 9B:
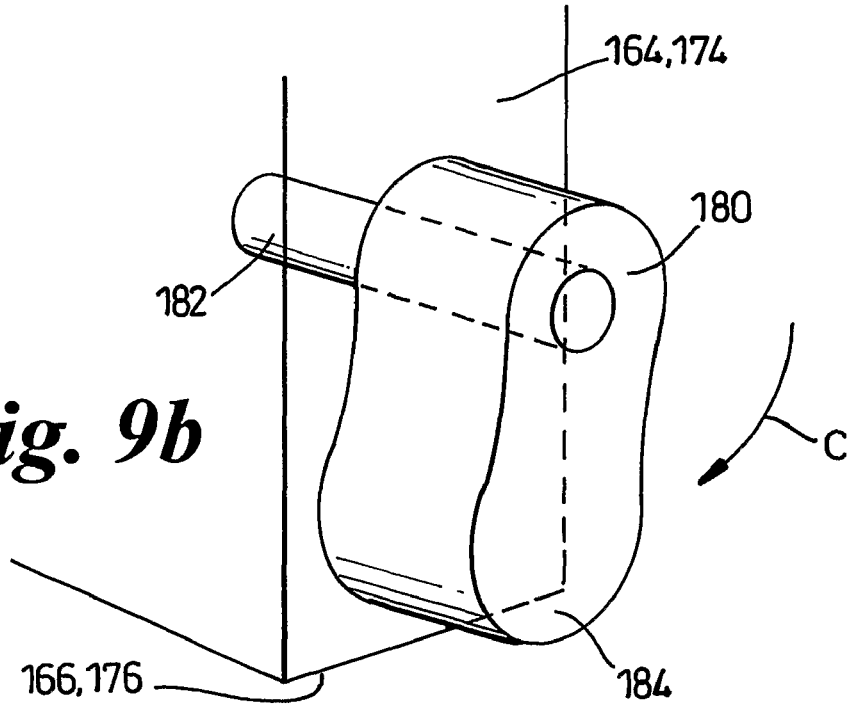
Figure 10A:
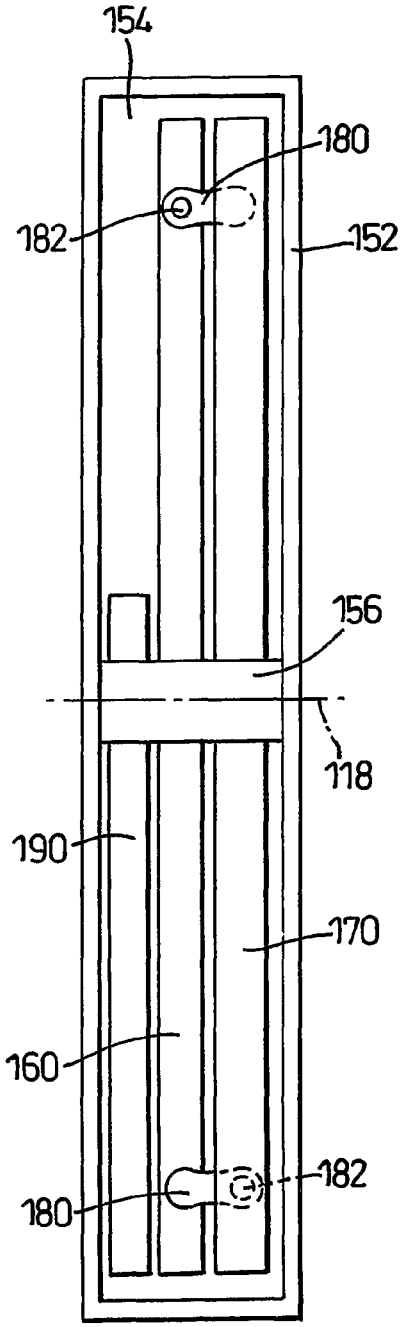
FIGS. 10*a* and 10*b* are sectional side views of the device of FIG. 8 with the catches shown in restraining and unrestraining positions respectively.
Figure 10B:
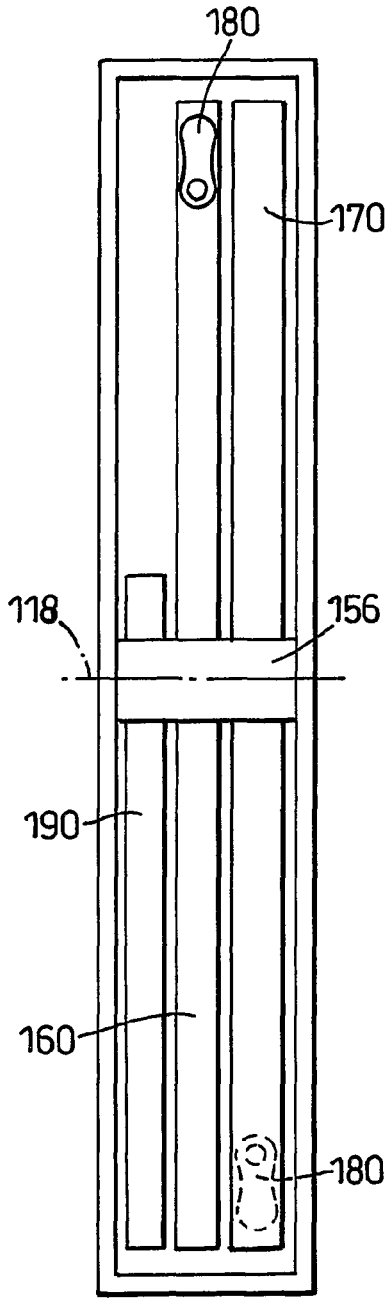

However, at speeds below the critical speed, it is necessary for at least one of the counterbalancing masses 160, 170, 190 to be restrained so that a non-zero resultant balancing force, which is able to rotate about the axis 118, is produced. This is achieved by the provision of catches 180 on the counterbalancing masses 160, 170 which, at sub-critical speeds, prevent relative rotation therebetween so that no resultant balancing force is produced by the two larger counterbalancing masses 160, 170. In the embodiment shown, one catch 180 is provided on each of the counterbalancing masses 160, 170 as shown in FIG. 8. The catch 180 itself is shown in more detail in FIGS. 9*a* and 9*b* and its operation is illustrated in FIGS. 10*a* and 10*b*.

Each catch 180 is located on an edge face 164, 174 of the respective counterbalancing mass 160, 170 close to the radially outermost edge 166, 176 thereof. The catch 180 is pivotably mounted on the counterbalancing mass 160, 170 by a pin 182 which is eccentrically positioned in the catch 180. The catch 180 is dimensioned so that the breadth b of the catch 180 is not greater than the axial depth d of the counterbalancing mass 160, 170. It is also dimensioned and positioned so that, when the catch 180 lies along the edge face 164, 174 of the respective counterbalancing mass 160, 170, the distal end 184 of the catch 180 does not protrude beyond the outermost edge 166, 176 of the counterbalancing mass 160, 170.

Each catch 180 is biased under the action of a spring (not shown) similar to that illustrated in FIGS. 3 and 4. The direction of bias is illustrated in FIG. 9*a* by arrow B. At speeds of rotation below the critical speed of the system, the action of the spring urges the catch 180 in the direction illustrated so that the catch 180 projects beyond the front or rear surface of the respective counterbalancing mass 160, 170. However, the shape and mass of the catch 180 and the characteristics of the spring are selected so that, at a predetermined speed of rotation, which is not less than the critical speed of the system, the centrifugal forces acting on the catch 180 will cause it to move against the action of the spring about the pin 182 in a direction illustrated by arrow C in FIG. 9*b*. This will bring the catch 180 into a position in which it is aligned with the edge face 164, 174 of the counterbalancing mass 160, 170 and does not project beyond the surface thereof. At no time does either catch 180 interfere with the free rotational movement of the third counterbalancing mass 190.

The catches 180 operate in the following manner. At speeds of rotation below the critical speed of the system, the catches 180 will be urged, under the action of the spring, towards the position shown in FIG. 9*a*. If the counterbalancing masses 160, 170 are in an overlapping position, the distal end 184 of each catch 180 will rest on and slide over the facing surface of the opposite counterbalancing mass 160, 170. As soon as the counterbalancing masses 160, 170 come into the position shown in FIG. 8, the catches 180 will move into the positions shown in FIG. 10*a* so that relative rotation between the counterbalancing masses 160, 170 is prevented. In this position, the balancing forces $F_{B1}$ generated by the rotation of the counterbalancing masses 160, 170 will be equal and opposite and thus there will be no resultant balancing force produced by the two counterbalancing masses 160, 170.

However, the third counterbalancing mass 190 remains unrestrained and able to rotate about the axis 118. The total resultant balancing force produced when the catches 180 are in operation is thus equal to the balancing force $F_{b1}$ described above and is freely rotatable about the axis 118. By selecting the shape and mass of the third counterbalancing mass 190, this balancing force can be selected to be less than either of the balancing forces $F_{B1}$ generated by the counterbalancing masses 160, 170. Ideally, it is selected to have a magnitude of less than one half, preferably approximately one third, of the maximum expected out-of-balance mass in the drum of the washing machine in which the device 150 is to be used. This ensures that the out-of-balance mass will be at least partially counterbalanced at speeds below the critical speed of the system. This is highly advantageous in that the maximum excursion of the drum is kept to a minimum as the drum approaches the critical speed of the system.

Once the drum has passed through the critical speed of the system, the counterbalancing masses 160, 170 must be released to allow them to counterbalance the out-of-balance mass in the drum. This is achieved, as has been described, by selecting the shape and mass of the catches 180 and the characteristics of the spring to allow the catches 180 to rotate about the pins 182 at a predetermined speed which is above the critical speed. At that speed, the catches 180 move to the positions shown in FIG. 10*b* so that neither counterbalancing mass 160, 170 is restrained any longer. The three counterbalancing masses 160, 170, 190 are thus able to adopt positions which achieve the desired counterbalancing effect at high speeds.

As with the previous embodiment, it is not essential that the catches 180 are operative at all lower speeds of rotation. However, as the speed of the device 150 drops below that at which the catches 180 move to the position shown in FIG. 10*b*, it is likely that the counterbalancing masses 160, 170 will at some stage adopt the position shown in FIG. 8. At that time, the catches 180 will move back into the positions shown in FIG. 10*a* under the action of the springs and the counterbalancing masses 160, 170 will again become restrained.

Figure 11:
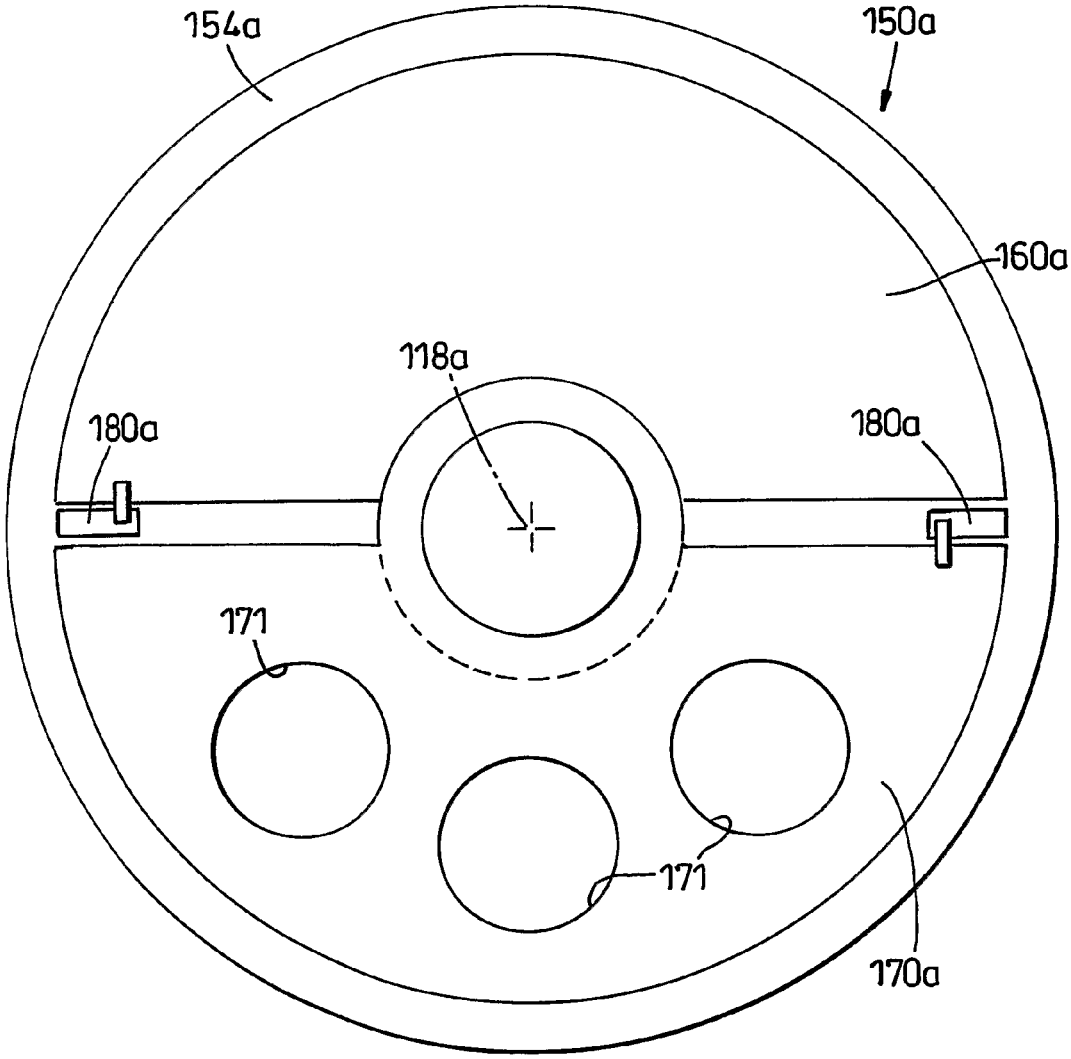
FIG. 11 is a front view of an automatic balancing device according to a third embodiment of the invention showing two counterbalancing masses held in a restrained position.

The third embodiment, which is illustrated in FIG. 11, is a variation on the second embodiment described above and includes many of the same features. The automatic balancing device 150*a* has a chamber 154*a* in which two counterbalancing masses 160*a* and 170*a* are mounted about an axis 118*a*. The arrangement is the same as that shown in FIG. 8, except that no third counterbalancing mass is provided in the arrangement of FIG. 11. Furthermore, the second counterbalancing mass 170*a* is formed so as to have three large holes 171 therethrough.

This means that the mass of the second counterbalancing mass 170*a* is significantly less than that of the first counterbalancing mass 160*a*.

The automatic balancing device 150*a* operates in a manner which is very similar to that in which the device 50 shown in FIGS. 1 to 7 operates. At speeds below the critical speed, the latches 180*a* restrain the movement of the counterbalancing masses 160*a*, 170*a* relative to one another. At these speeds, because the masses of the counterbalancing masses 160*a*, 170*a* are different, a resultant balancing force will be produced even though the counterbalancing masses 160*a*, 170*a* are latched in a diametrically opposed position. The magnitude of this resultant balancing force will remain constant because the counterbalancing masses 160*a*, 170*a* cannot move relative to one another, but it is free to rotate about the axis 118*a* because the counterbalancing masses 160*a*, 170*a* can also rotate together about the axis 118*a*. However, the size and position of the holes 171 can be selected so that the criteria mentioned above are fulfilled; ie. the resultant balancing force when the counterbalancing masses 160*a*, 170*a* are latched together is between 5% and 35%, preferably between 15% and 20%, of the maximum achievable resultant balancing force.

When the device 150*a* achieves a speed above the critical speed of the system in which it is used, and the catches 180*a* move to their inoperative position as described above in relation to the second embodiment, the counterbalancing masses 160*a*, 170*a* are free to adopt positions in which the out-of-balance mass in the rotating body of the system is counterbalanced. Unlike the first and second embodiments described above, the different masses of the counterbalancing masses 160*a*, 170*a* mean that, in the event that there is no out-of-balance mass present in the rotating body, some resultant balancing force will always remain. In the application of a washing machine, it is extremely unlikely that there will be no out-of-balance mass present in the drum and so an embodiment of this sort has application in washing machines.

Figure 12:
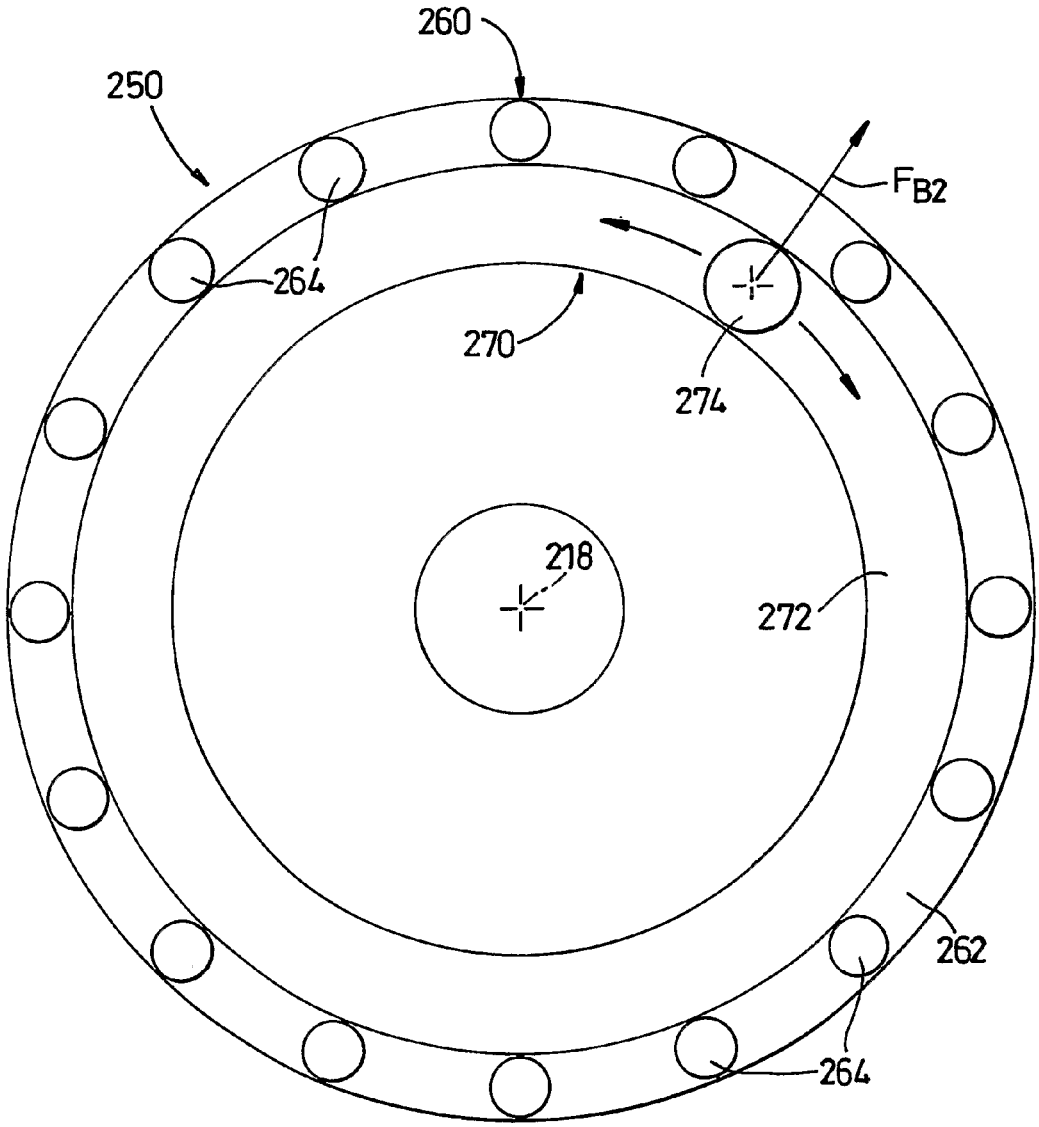
FIG. 12 is a front view of an automatic balancing device according to a fourth embodiment of the invention showing all but one of the counterbalancing masses held in a balanced position.
Figure 13A:
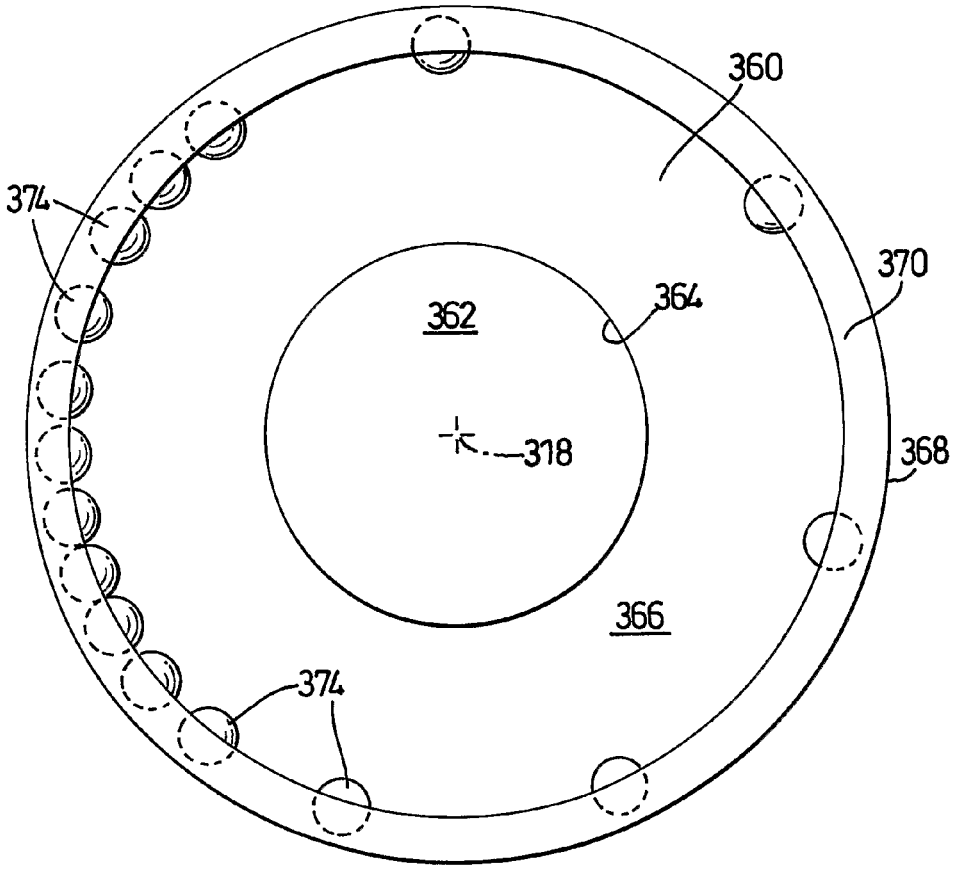
FIGS. 13*a* and 13*b* are, respectively, plan and side views of a fifth embodiment of an automatic balancing device according to the invention and showing the position of the counterbalancing masses at the second speed of rotation.
Figure 13B:
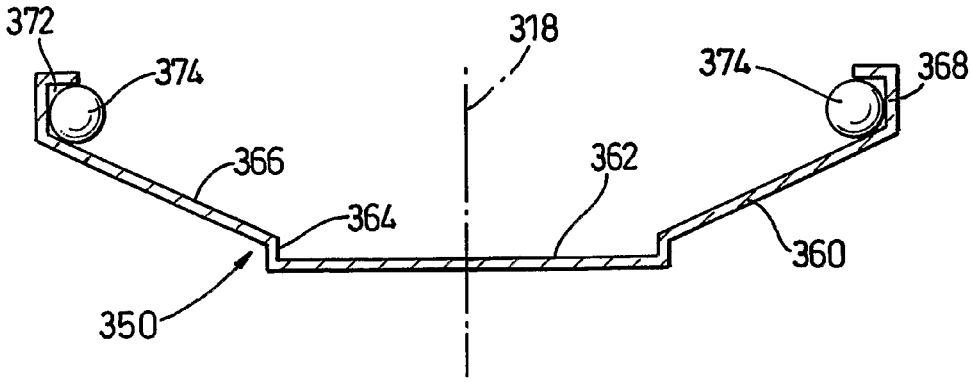

A fourth embodiment of the invention is illustrated in FIG. 12. In this embodiment, the automatic balancing device 250 comprises two separate, annular ballraces 260, 270 which are arranged to be concentric with the axis 218 about which the drum, or other rotating body in which the out-of-balance mass to be counterbalanced is located, rotates. The first ballrace 260 is of the type which is known in the art. It comprises an annular race 262 in which a plurality of identical balancing balls 264 are located. A viscous fluid such as oil (not shown) provides viscous coupling between the wall of the race 262 and the balls 264. The balls 264 are dimensioned so that, when they lie adjacent one another, they occupy less than half of the race 262 so as to maximize their balancing effect. A mechanism (not shown), which is operative at speeds below the critical speed of the system in which the device 250 is used, is provided for fixing the balls 264 at equispaced positions around the race 262. When the balls 264 are held in those positions, they are balanced about the axis 218 and no resultant balancing force is produced. An example of a suitable mechanism for retaining the balls 264 in the predetermined positions (as shown in FIG. 12) is shown and described in U.S. Pat. No. 5,813,253. Other suitable mechanisms will be apparent to a skilled reader.

The second ballrace 270 has a very simple construction. It consists of a simple annular race 272 in which a single ball 274 is located. No mechanism is provided for fixing the ball 274 in any given position. Viscous coupling is again provided by a viscous fluid such as oil.

In operation, and when the device 250 is rotating at speeds above the critical speed of the system, the mechanism by means of which the balls 264 are held in their fixed positions about the axis 218 is inoperative. The balls 264, as well as the ball 274, are free to adopt positions within their respective races 262, 272 in which the out-of-balance mass present in the drum or other rotating body is counterbalanced in a known manner. However, when the device 250 drops to a speed at which the mechanism becomes operative, the balls 264 in the outer race 262 will become fixed in their predetermined, balanced positions. In these positions, no resultant balancing force is produced by the balls 264.

Because the ball 274 is not restricted in any way, it remains free to move about the axis 218. The balancing force $F_{B2}$, which is the balancing force generated solely by the ball 274, is now the only balancing force which has any effect and so is equal to the resultant balancing force of the device 250. This resultant balancing force can be selected to be equal to as much as half of the maximum resultant balancing force produced when the balls 264 are all located adjacent one another by appropriate selection of the size and mass of the ball 274.

Because there is only one ball 274 present in the ballrace 270, there must be a resultant balancing force of constant magnitude produced when the device 250 is rotated. If more than one ball were present in the ballrace 270, it would be possible for those balls to adopt a balanced arrangement which would result in no resultant being produced, or for the resultant balancing force to be variable. The concept behind the invention is to provide a constant resultant balancing force which is moveable about the axis 218 which is achieved by the arrangement shown in FIG. 12.

At speeds below the speed at which the restraining mechanism becomes operative, the resultant balancing force $F_{B2}$ is used to partially counterbalance the out-of-balance mass present in the rotating body in which the device 250 is used. As the speed of the device 250 then increases towards the critical speed of the system, the maximum excursion of the body is kept to a minimum by virtue of the partial counterbalancing. When the rotating body has accelerated to a speed above the critical speed of the system, the mechanism is released to allow the balls 264 to contribute to the counterbalancing effect and so provide effective counterbalancing of a wide range of out-of-balance masses.

The previously described embodiments are all primarily suitable for use with bodies which rotate about a horizontal (or substantially horizontal) axis, although they could also be used in machines having a substantially vertical axis. The fifth embodiment, which is illustrated in FIGS. 13*a*, 13*b*, 14*a* and 14*b*, is however well suited for use with a body which rotates about a vertical (or substantially vertical) axis. In the embodiment, the device 350 consists of a support surface 360 which is mounted concentrically with the axis 318 about which the body in which the out-of-balance mass to be counterbalanced is present. The support surface 360 comprises a circular central portion 362 surrounded by a cylindrical lip 364. An inclined portion 366 extends upwardly and outwardly from the upper edge of the lip 364 to a cylindrical wall 368 and an overhanging lip 370. The uppermost part of the inclined portion, the cylindrical wall 368 and the overhanging lip 370 combine to form an annular race 372.

Figure 14A:
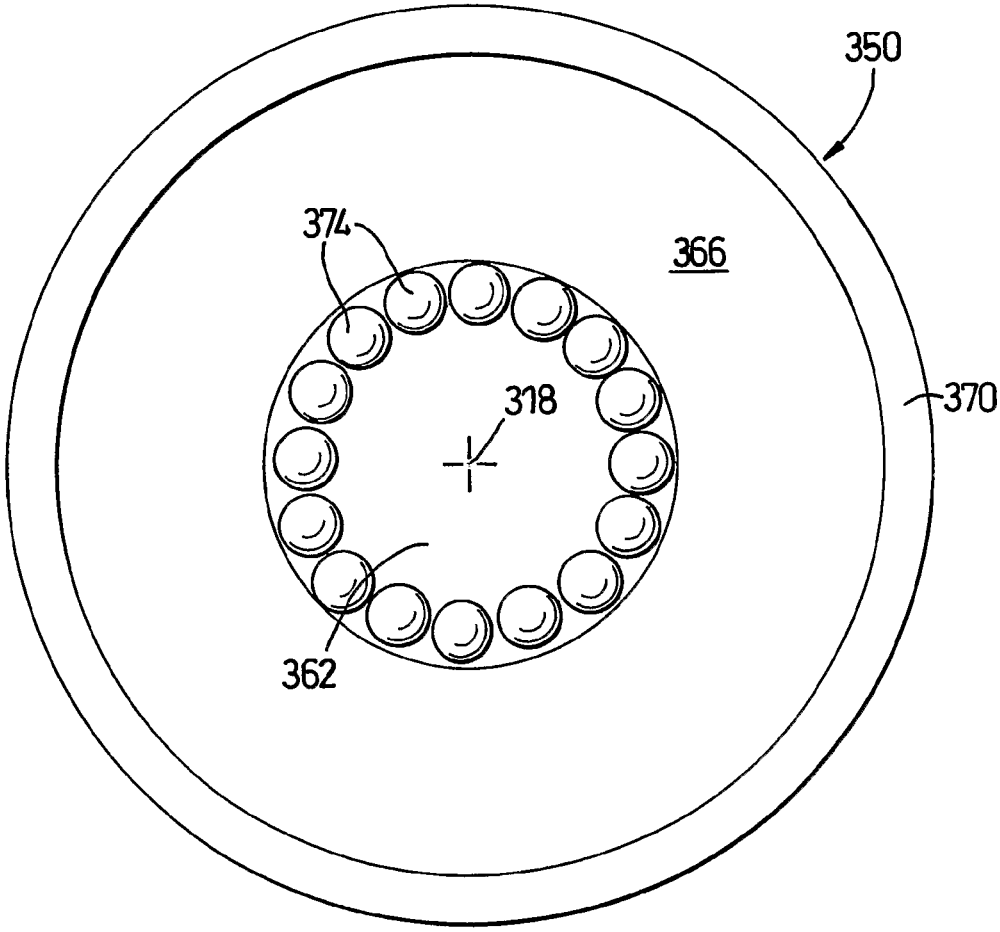
FIGS. 14*a* and 14*b* are, respectively, plan and side views of the automatic balancing device of FIGS. 13*a* and 13*b* and showing the position of the counterbalancing masses at the first speed of rotation.

A plurality of balancing balls 374 are provided on the upper surface of the support surface 360. In the embodiment shown, sixteen balls 374 are provided. All of the balls 374 have the same diameter. The diameter of the balls 374 is chosen so that, when the balls 374 are arranged at the outermost extremity of the central portion 362, ie. abutting against the lip 362, then the balls 374 fit around the circumference of the central portion without play, as shown in FIG. 14*a*. The balls 374 are also dimensioned so that they will fit into the annular race 372 in a manner which allows them to roll therein. The height of the lip 364 is chosen so as to be slightly less than the radius of the balls 374 for reasons which will be explained below.

Three of the balls 374 are manufactured from a material which is significantly lighter than the material from which the other balls 374 are manufactured. The number of balls which are so manufactured can be varied but only within certain limits. It is acceptable for only one of the balls 374 to be lightweight but, if more than one of the balls is a lightweight ball, the number of lightweight balls must not be a factor of the total number of balls. The reasons for this will become clear as the operation of the device 350 is explained.

Figure 14B:
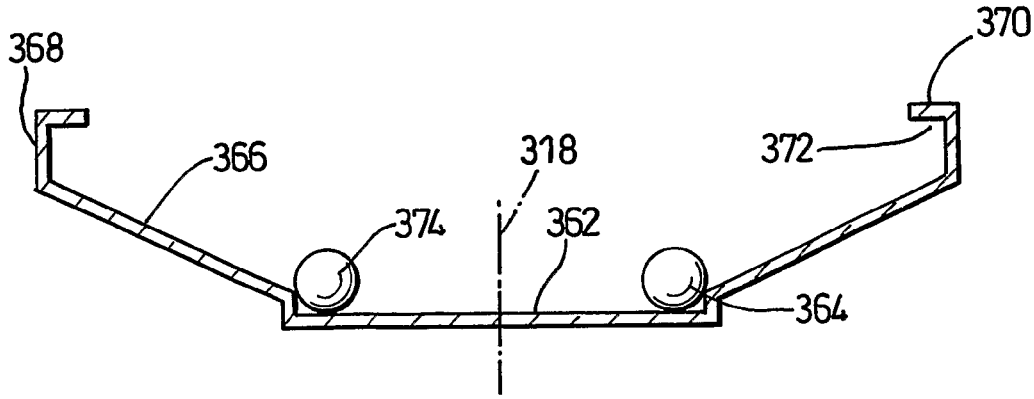

When the device 350 is rotating at low speeds, the balls drop downwards under the influence of gravity and fall into the central portion 362, as shown in FIGS. 14*a* and 14*b*. As has been explained, the balls 374 fit snugly around the outer part of the central portion 362 and so are prevented from moving with respect to one another as the device 350 rotates. If all the balls 374 were of the same mass, no resultant balancing force would be produced because the individual balancing forces would all be equidistantly spaced about the axis. However, because three of the balls 374 are substantially lighter than the other, a resultant balancing force is produced. Its magnitude will depend upon the position of the lightweight balls, which is not controlled. It will be greatest when the three lightweight balls lie next to one another and least when they are as close to being equidistantly spaced as the geometry of the arrangement will allow.

If the number of lightweight balls is greater than one and a factor of the total number of balls 374, there is a possibility that the lightweight balls will position themselves so as to be equispaced about the axis 318. This would produce no resultant balancing force and so is not permitted (unless the mass of each lightweight ball were different from the other lightweight balls).

In this configuration, and at speeds below the critical speed, the resultant balancing force is used to partially counterbalance the out-of-balance mass in the rotating body. As the speed of rotation increases and approaches the critical speed, the counterbalancing effect of the device 350 increases. The maximum excursion of the rotating body is thus minimized at the most crucial point.

As the body passes through the critical speed, the centrifugal forces acting on the balls 374 increases to such an extent that the balls 374 ride over the lip 364 and onto the inclined portion 366. This is only possible if the height of the lip 364 is less than the radius of the balls 374 although the height of the lip 364 must be sufficient to maintain the balls 374 in the central portion 362 at speeds below the critical speed. The balls 374 then travel upwardly across the inclined portion 366 to the annular race 372 in which there are no restraints on any of the balls 374. At these high speeds, the balls are free to adopt positions in which the out-of-balance mass in the rotating body is counterbalanced.

It will be appreciated that, as the speed of the rotating body slows to below-critical speeds, the balls 374 descend across the inclined portion 366 and fall back into the central portion 362. The positions in which the lightweight balls appear when the balls return to the central portion 362 may not be the same as the positions in which they appeared the previous time the balls 374 were located in the central portion but that does not matter. As long as the balls 374 are not equispaced about the axis 318, a constant resultant balancing force will still be produced.

Figure 15A:
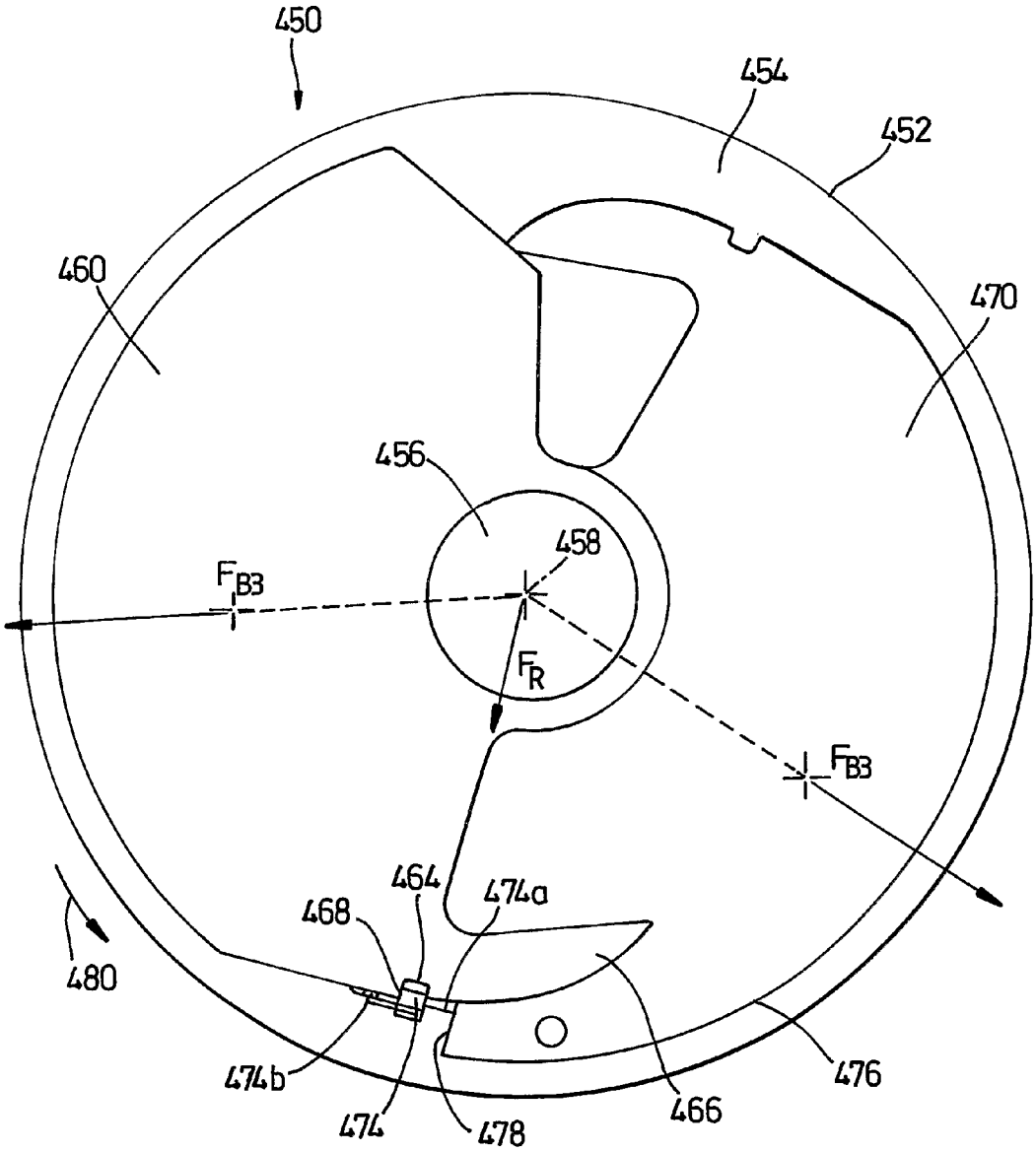
FIGS. 15*a* and 15*b* are, respectively, plan and isometric views of a sixth embodiment of an automatic balancing device according to the invention and showing the position of the counterbalancing masses at the first speed of rotation.
Figure 15B:
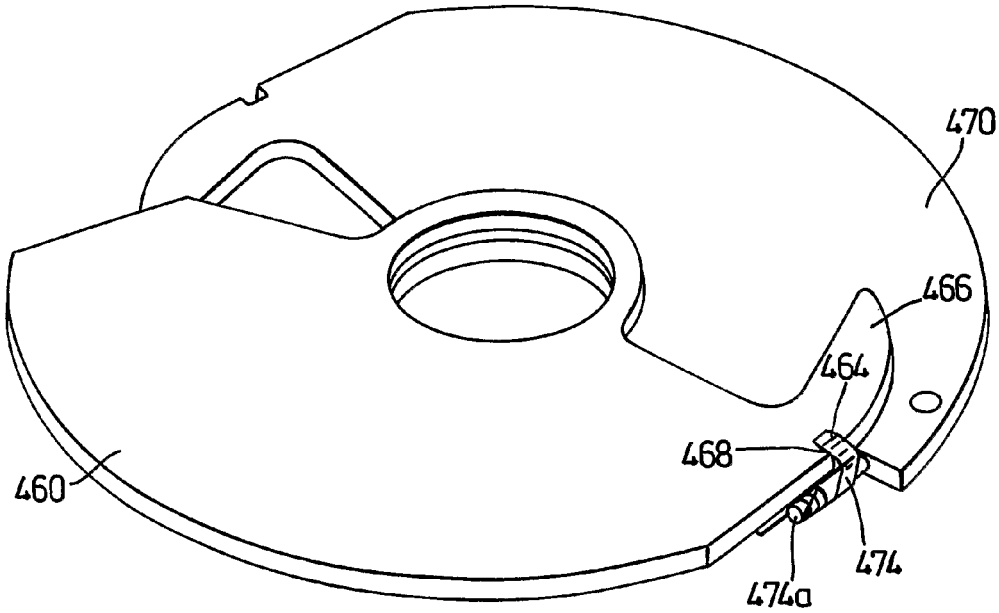
Figure 15C:
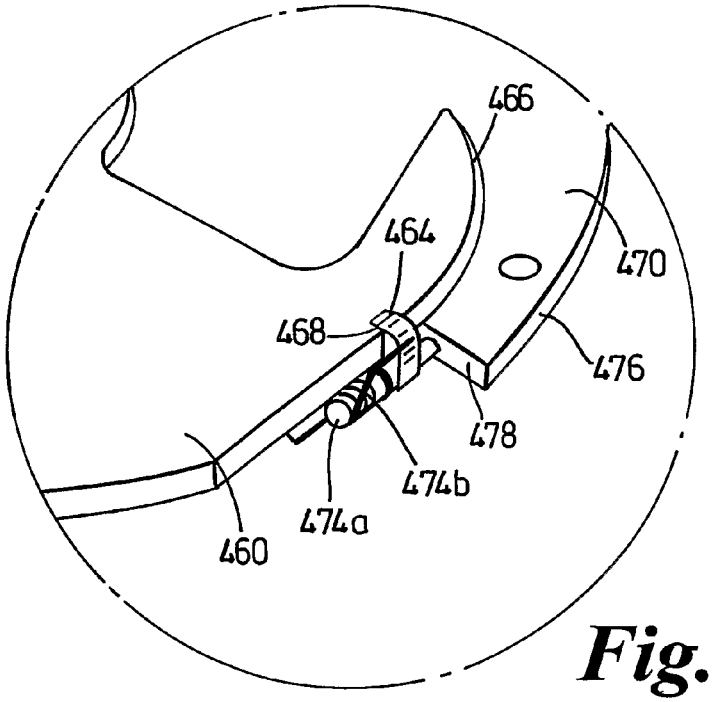
FIG. 15*c* is an enlarged view of the catch shown in FIGS. 15*a* and 15*b*.

A sixth embodiment of the invention is shown in FIGS. 15*a* to 15*c*. In this embodiment, the automatic balancing device 450 again comprises a wall 452 which defines a cylindrical chamber 454. A viscous fluid (not shown) is provided in the chamber 454 to provide viscous coupling between the wall 452 and the counterbalancing masses 460, 470. The counterbalancing masses 460, 470 are supported next to one another on an axle 456 so as to be freely rotatable about the axis 458, which is concentric with the drum of the washing machine or other dynamic system in which the device 450 is used.

At speeds below the critical speed, the counterbalancing masses 460, 470 are restrained so that a non-zero resultant balancing force $F_R$, which is freely movable about the axis 458, is produced. This is achieved by the provision of a catch 474 on the counterbalancing mass 470 which, at speeds below the critical speed, is received by a notch 464 on the other counterbalancing mass 460. The catch 474 is shown located in the notch 464 in FIGS. 15*a* to 15*c*.

The catch 474 is positioned close to an outer circumferential edge 476 of the counterbalancing mass 470. This allows the catch 474 to be at least partially submerged in the viscous fluid at all speeds of rotation. This reduces noise and wear on the catch 474 and the counterbalancing masses 460, 470. The catch 474 is pivotably mounted on a pin 474*a* which extends from an edge face 478 of the counterbalancing mass 470 in a substantially circumferential direction. Attached to the pin 474*a* is a spring 474*b*. The spring 474*b* applies a biasing force to the catch 474 which urges the catch 474 towards the axis 458.

The catch 474 operates in the following manner. At speeds of rotation below the critical speed of the system, the catch 474 will be urged towards the axis 458, as described. When the counterbalancing mass 460 is moving in an anti-clockwise direction relative to the counterbalancing mass 470 (see the arrow 480 shown in FIG. 15*a*), the counterbalancing masses 460, 470 will become oriented such that a ramp portion 466 of counterbalancing the counterbalancing mass 460 is adjacent to the catch 474. The catch 474 will be displaced by the ramp portion 466 in a direction away from the axis 458. As the counterbalancing masses 460, 470 continue to move relative to one another, the catch 474 will contact an abutment surface 468 and become trapped in the notch 464. In this position, relative rotation between the counterbalancing masses 460, 470 will be prevented and the balancing forces $F_{B3}$ generated by the rotation of the counterbalancing masses 460, 470 will combine to give a fixed resultant balancing force $F_R$.

As discussed above, the catch 474 is able to engage with the notch 464 if the counterbalancing mass 460 is moving in an anti-clockwise direction relative to the counterbalancing mass 470. However, the catch 474 is also able to engage with the notch 464 when the counterbalancing mass 460 is moving in a clockwise direction relative to the counterbalancing mass 470, provided that the relative speed of rotation between the counterbalancing masses 460, 470 is low. At higher speeds, the catch 474 will not engage with the notch 464 and the counterbalancing masses 460, 470 will continue to move relative to one another until the relative speed is lower.

The unlocking of the counterbalancing masses 460, 470 is achieved in the following way. The shape and mass of the catch 474 and the characteristics of the spring 474*b* are selected such that, at or above a pre-determined speed which is greater than the critical speed, the centrifugal forces acting on the catch 474 are sufficient to overcome the biasing force of the spring 474*b*. This allows the catch 474 to pivot about the pin 474*a* and move radially outwards to a position where it is not located in from the notch 464. The counterbalancing masses 460, 470 are then free to assume positions about the axis 458 which will counterbalance any out-of-balance mass present in the drum of the washing machine (or other dynamic system) in a manner similar to the previous embodiments.

The invention is not limited to the precise details of the embodiment described above, as will be apparent to and appreciated by the skilled reader. Variations and modifications are intended to fall within the scope of the invention of this application. For example, in the embodiments illustrated, the restraining means (the latch 80 of the first embodiment, the catches 180, 180*a* of the second and third embodiments, the non-illustrated restraining means of the fourth embodiment, the cylindrical lip 364 of the fifth embodiment and the catch 474 of the sixth embodiment) are designed to hold the relevant counterbalancing masses in fixed positions relative to one another. However, it is to be understood that some play can be allowed between the restraining means and the counterbalancing masses whilst still maintaining a beneficial effect. In the first embodiment, the recess 88 can be made larger in the circumferential direction than the depth of the head portion 84. This will allow some relative movement between the counterbalancing masses 60, 70 whilst the restraining means (latch 80) is operative. This movement can be as much as several degrees. Similarly, in the second and third embodiments, a certain amount of play can be allowed between the catches 180, 180*a* and the edge faces 164, 174 of the relevant counterbalancing masses 160, 170; 160*a*, 170*a* and, in the fifth embodiment, play can be allowed between the balls 364 when they are positioned at the outermost part of the central portion 362 and against the cylindrical lip 364. In each of these cases, whilst the magnitude and position of the resultant balancing force produced whilst the restraining means are operative may vary somewhat, the variation is insufficient to detract from the benefit achieved by the invention.

Other variations which are intended to fall within the scope of the invention include the provision of additional counterbalancing masses and counterbalancing masses of different shapes in the first and second embodiments, alternative latching mechanisms in the first, second and third embodiments, additional ballraces in the fourth embodiment, ballraces spaced axially instead of radially in the fourth embodiment, and different numbers of balls and variations in size in the fifth embodiment.

Two or more of the devices described above can be combined to produce a mechanism in which a first of the devices is positioned on one side of the rotatable body and a second of the devices is positioned on the other side of the rotatable body. The devices are then spaced along the axis about which the body rotates. The devices are coaxial. The devices are preferably identical but this is not essential. This is advantageous in that balancing of a wide range of out-of-balance masses present in the rotating body can be counterbalanced effectively, both above and below the critical speeds, without requiring either automatic balancing device to be particularly large in dimensions or mass.

The invention claimed is:

1. An automatic balancing device for counterbalancing an out-of-balance mass present in a body which is rotatable about an axis of a dynamic system having a critical speed, comprising:

a plurality of counterbalancing masses, each of which is movable in a circular path about the axis so as to generate an individual balancing force, wherein the individual balancing forces combine to generate a resultant balancing force having a magnitude that is variable between a minimum value and a maximum value depending, at least in part, on relative positions of the counterbalancing masses, and a restraint configured to restrain at least two of the counterbalancing masses in a fixed relationship to each other when the at least two counterbalancing masses move at a first speed of rotation that is below the critical speed, and to allow the at least two counterbalancing masses to move relative to each other when the at least two counterbalancing masses move at a second speed of rotation that is equal to or greater than the critical speed, wherein when the at least two counterbalancing masses are restrained in the fixed relationship to each other, the restrained counterbalancing masses are movable, in the fixed relationship, about the axis and independent from the body so as to generate a substantially constant non-zero resultant balancing force that is freely movable about the axis.

2. An automatic balancing device as claimed in claim 1, wherein the second speed of rotation is any speed above a predetermined speed which is higher than the critical speed.

3. An automatic balancing device as claimed in claim 1 or 2, wherein the minimum value of the magnitude of the resultant balancing force is zero.

4. An automatic balancing device as claimed in claim 1 or 2, wherein, at the first speed of rotation, the magnitude of the substantially constant non-zero resultant balancing force is less than half of the maximum value.

5. An automatic balancing device as claimed in claim 4, wherein, at the first speed of rotation, the magnitude of the resultant balancing force lies in the range 5% to 35% of the maximum value.

6. An automatic balancing device as claimed in claim 4, wherein, at the first speed of rotation, the magnitude of the resultant balancing force lies in the range 15% to 20% of the maximum value.

7. An automatic balancing device as claimed in claim 1, wherein the restraint is movable between an operative position and an inoperative position.

8. An automatic balancing device as claimed in claim 7, wherein the restraint comprises a latching system which, when in the operative position, limits the movement of at least one of the counterbalancing masses relative to at least one other counterbalancing mass.

9. An automatic balancing device as claimed in claim 8, wherein the counterbalancing masses are pivotably mounted about the axis and the latching system, when in the operative position, prevents relative movement between at least two counterbalancing masses whilst permitting pivotal movement about the axis.

10. An automatic balancing device as claimed in claim 9, wherein two counterbalancing masses are provided and, when the latching system is in the operative position, the angle between the balancing forces generated thereby is between 140° and 175°.

11. An automatic balancing device as claimed in claim 9, wherein two counterbalancing masses are provided and, when the latching system is in the operative position, the angle between the balancing forces generated thereby is between 155° and 165°.

12. An automatic balancing device as claimed in claim 9, wherein the latching system comprises at least one latch or catch which is mounted on a first of the counterbalancing masses and which interengages with a second of the counterbalancing masses.

13. An automatic balancing device as claimed in claim 12, wherein the latch or catch is configured so as to release the second counterbalancing mass at the second speed of rotation of the body about the axis.

14. An automatic balancing device as claimed in claim 13, wherein the latch is located on an outer circumferential edge of the first counterbalancing mass.

15. A mechanism for counterbalancing an out-of-balance mass present in a body which is rotatable about an axis, comprising a first automatic balancing device as claimed in claim 1 or 2 and a second automatic balancing device as claimed in claim 1 or 2, the first and second automatic balancing devices being arranged coaxially but spaced apart from one another along the d axis.

16. A mechanism as claimed in claim 15, wherein the first and second automatic balancing devices are substantially identical to one another.

17. A mechanism as claimed in claim 15, wherein the first and second automatic balancing devices are arranged on either side of the body.

18. A method of counterbalancing an out-of-balance mass present in a body which is rotatable about an axis of a dynamic system having a critical speed, the body being provided with an automatic balancing device having a plurality of counterbalancing masses, each of which is moveable in a circular path about the axis, the method comprising:

rotating the body at a speed which is below the critical speed of the system of which the body forms a part so that each counterbalancing mass generates an individual balancing force, wherein the individual balancing forces combine to generate a resultant balancing force having a magnitude that is variable between a minimum value and a maximum value depending, at least in part, on relative positions of the counterbalancing masses;

restraining with a restraint movement of at least two of the counterbalancing masses in a fixed relationship to each other when the at least two counterbalancing masses move at a first speed of rotation that is below the critical speed, wherein when the at least two counterbalancing masses are restrained in the fixed relationship to each other, the restrained counterbalancing masses are movable, in the fixed relationship, about the axis and independent from the body in such a manner that a substantially constant, non-zero resultant balancing force is produced, the resultant balancing force being freely moveable about the axis;

increasing the speed of rotation of the body to a speed above the critical speed of the system of which the body forms a part; and removing the restraint from the counterbalancing masses allowing the at least two counterbalancing masses to move relative to each other when the at least two counterbalancing masses move at a second speed of rotation that is equal to or greater than the critical speed.

19. A method as claimed in claim 18, wherein the restraining step includes connecting all of the counterbalancing masses to one another to prevent relative movement therebetween while allowing rotation of the connected counterbalancing masses about the axis.

20. A method as claimed in claim 19, wherein the counterbalancing masses are connected in a position which produces a magnitude of the resultant balancing force of between 5% and 35% of the maximum value.

21. A method as claimed in claim 19, wherein the counterbalancing masses are connected in a position which produces a magnitude of the resultant balancing force of between 15% and 20% of the maximum value.

* * * * *